US012082691B2

(12) United States Patent
Koenig

(10) Patent No.: US 12,082,691 B2
(45) **Date of Patent: *Sep. 10, 2024**

(54) WORK STATION HAVING A MULTI-PURPOSE WORK SURFACE

(71) Applicant: David Raymond Koenig, Highland Park, IL (US)

(72) Inventor: David Raymond Koenig, Highland Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/222,650

(22) Filed: Jul. 17, 2023

(65) Prior Publication Data

US 2024/0041199 A1 Feb. 8, 2024

Related U.S. Application Data

(63) Continuation of application No. 17/886,897, filed on Aug. 12, 2022, now Pat. No. 11,700,936, which is a (Continued)

(51) Int. Cl.
*A47B 5/06* (2006.01)
*A47B 5/04* (2006.01)

(Continued)

(52) U.S. Cl.
CPC ..... *A47B 5/06* (2013.01); *A47B 5/04* (2013.01); *A47B 9/20* (2013.01); *A47B 21/02* (2013.01);

(Continued)

(58) Field of Classification Search
CPC .... A47B 5/06; A47B 5/04; A47B 5/00; A47B 21/02; A47B 2200/0066; A47B 2200/0051; A47B 9/20

(Continued)

(56) References Cited

U.S. PATENT DOCUMENTS 2,944,861 A 7/1960 Lessin
3,083,417 A 4/1963 Cook (Continued)

FOREIGN PATENT DOCUMENTS

CN 202476859 U 10/2012
DE 2447207 A1 4/1976

(Continued)

OTHER PUBLICATIONS

Notice of Allowance dated Mar. 2, 2023, from U.S. Appl. No. 17/886,897, 157 sheets.

(Continued)

*Primary Examiner* — Jose V Chen
(74) *Attorney, Agent, or Firm* — KATTEN MUCHIN ROSENMAN LLP

(57) ABSTRACT

A work station including a base includes a work surface pivotally mounted to the base so as to be configured to pivot between a first position and a second position. The work surface is configured to cover a protected member when in a first position and the work surface is configured to uncover the protected member when moved into a second position. The base is configured to support the work surface on a floor surface. A height of the work surface can be adjusted to accommodate the ergonomic needs of different users.

19 Claims, 42 Drawing Sheets

Related U.S. Application Data continuation of application No. 17/121,403, filed on Dec. 14, 2020, now Pat. No. 11,419,409.

(60) Provisional application No. 63/106,111, filed on Oct. 27, 2020, provisional application No. 62/947,271, filed on Dec. 12, 2019.

(51) Int. Cl.
*A47B 9/20* (2006.01)
*A47B 21/02* (2006.01)

(52) U.S. Cl.
CPC ..... *A47B 2200/0051* (2013.01); *A47B 2200/0066* (2013.01)

(58) Field of Classification Search
USPC ..... 108/42, 48, 50.01
See application file for complete search history.

(56) References Cited

U.S. PATENT DOCUMENTS

| | | | | |
|---|---|---|---|---|
| 4,099,469 | A | 7/1978 | Sahli | |
| 4,436,353 | A | 3/1984 | Tucker | |
| 5,373,793 | A | 12/1994 | Crossman | |
| 5,469,794 | A | 11/1995 | Laderoute | |
| 5,669,314 | A | 9/1997 | Grant | |
| 5,819,670 | A | 10/1998 | O'Connor | |
| 5,911,178 | A | 6/1999 | Alexander | |
| 6,039,416 | A | 3/2000 | Lambert | |
| 6,161,486 | A | 12/2000 | Boots | |
| 6,164,217 | A | 12/2000 | Prendergast | |
| 6,220,180 | B1 | 4/2001 | Janowitz | |
| 6,647,900 | B1 | 11/2003 | Kopish | |
| 6,698,364 | B2 | 3/2004 | Welch | |
| 6,786,162 | B1 | 9/2004 | Volkmer | |
| 6,997,115 | B2 | 2/2006 | Lockwood | |
| 7,066,098 | B2 | 6/2006 | Blasen | |
| 7,631,604 | B2 | 12/2009 | Huang | |
| 7,975,625 | B2 | 7/2011 | Topham | |
| 7,975,626 | B1 | 7/2011 | Wang | |
| 8,015,928 | B2 | 9/2011 | Chen | |
| 8,297,207 | B2 | 10/2012 | Liu | |
| 8,312,820 | B2 | 11/2012 | Rotlevi | |
| 8,365,676 | B1 | 2/2013 | McAuliff | |
| 8,381,664 | B2 | 2/2013 | Prendergast | |
| 8,424,466 | B2 | 4/2013 | Botkin | |
| 8,539,888 | B2 | 9/2013 | Hernandez et al. | |
| 8,662,605 | B2 | 3/2014 | Mcrorie et al. | |
| 9,723,919 | B1 | 8/2017 | Randolph et al. | |
| 9,999,295 | B1 | 6/2018 | Game | |
| 10,918,202 | B1 | 2/2021 | Sie | |
| 11,419,409 | B2 * | 8/2022 | Koenig | A47B 21/02 |
| 11,700,936 | B2 * | 7/2023 | Koenig | A47B 46/005 108/48 |
| 2002/0145088 | A1 | 10/2002 | Santoro et al. | |
| 2004/0173124 | A1 | 9/2004 | Chang | |
| 2005/0274300 | A1 | 12/2005 | Chen | |
| 2007/0209559 | A1 | 9/2007 | Mockel | |
| 2008/0017083 | A1 | 1/2008 | VanNimwegen | |
| 2008/0168930 | A1 | 7/2008 | Calero | |
| 2009/0133609 | A1 | 5/2009 | Nethken | |
| 2010/0148647 | A1 | 6/2010 | Burgess et al. | |
| 2010/0258042 | A1 | 10/2010 | Rutz | |
| 2011/0120351 | A1 | 5/2011 | Shoenfeld | |
| 2012/0212116 | A1 | 8/2012 | Mcrorie et al. | |
| 2012/0218701 | A1 | 8/2012 | Thomas | |
| 2012/0242204 | A1 | 9/2012 | Boyer | |
| 2012/0255465 | A1 | 10/2012 | Hernandez | |
| 2013/0000525 | A1 | 1/2013 | Hall | |
| 2013/0255544 | A1 | 10/2013 | Scharing | |
| 2013/0305964 | A1 | 11/2013 | Swallow | |
| 2014/0245932 | A1 | 9/2014 | Mckenzie, III | |
| 2017/0135587 | A1 | 5/2017 | Desroches | |
| 2017/0295920 | A1 | 10/2017 | Randolph et al. | |
| 2017/0354370 | A1 | 12/2017 | Hedin | |
| 2018/0352950 | A1 | 12/2018 | Bowman | |
| 2019/0069669 | A1 | 3/2019 | Hall | |
| 2019/0150609 | A1 | 5/2019 | Salehi | |
| 2019/0254418 | A1 | 8/2019 | Ryholl | |
| 2020/0170407 | A1 | 6/2020 | Knapp | |
| 2020/0359785 | A1 | 11/2020 | Lu | |
| 2021/0068532 | A1 | 3/2021 | Blewett | |
| 2021/0177136 | A1 | 6/2021 | Koenig | |
| 2021/0186207 | A1 | 6/2021 | Heyring | |
| 2021/0259403 | A1 | 8/2021 | Swetharanyam | |

FOREIGN PATENT DOCUMENTS

| | | | |
|---|---|---|---|
| DE | 102016108036 | A1 | 1/2017 |
| DE | 202018005975 | U1 | 2/2019 |
| JP | 55-38990 | U1 | 3/1980 |
| WO | 2011005182 | A1 | 1/2011 |
| WO | 2016050941 | A1 | 4/2016 |
| WO | 2021237302 | A1 | 12/2021 |

OTHER PUBLICATIONS

Non-Final Rejection dated Dec. 21, 2022, from U.S. Appl. No. 17/886,897, 100 sheets.

Notice of Allowance dated Apr. 18, 2022, from U.S. Appl. No. 17/121,403, 49 sheets.

Non-Final Rejection dated Dec. 14, 2021, from U.S. Appl. No. 17/121,403, 34 sheets.

Final Rejection dated Feb. 18, 2022, from U.S. Appl. No. 17/121,403, 28 sheets.

The Extended European Search Report dated Nov. 30, 2023, from European Application No. 20899607.4, 8 sheets.

Notification of Reasons for Refusal dated Sep. 5, 2023, from Japanese Application No. 2022-535955, 4 sheets.

Building a spectacular DIY 'desk PC' (it can fold!), https://www.youtube.com/watch?v=QaoFh1DH51U, dated Jun. 3, 2019.

International Search Report and Written Opinion mailed Mar. 10, 2021, from International Patent Application No. PCT/US2020/064917, 14 sheets.

Office Action dated Dec. 13, 2023, from Canadian Application No. 3,161,312, 4 sheets.

First Office Action issued Apr. 22, 2024, from Chinese Application No. 202080093217.5, 21 sheets including English translation.

Notice of Reasons for Rejection dated Jun. 11, 2024, from Japanese Patent Application No. 2022-535955, 4 sheets including English translation.

* cited by examiner 100
102
104
106
107
108
110
111
112
114
116
118

200
202
204
206
207
208
210
212
214
216

300
302
304
306
307
308
310
312
314
316
320

WORK STATION HAVING A MULTI-PURPOSE WORK SURFACE

CROSS-REFERENCE TO RELATED APPLICATIONS

This application is a continuation of U.S. patent application Ser. No. 17,886,897, filed Aug. 12, 2022, which is a continuation of U.S. patent application Ser. No. 17/121,403, filed Dec. 14, 2020, now U.S. Pat. No. 11,419,409, issued Dec. 1, 2022, which claims priority to U.S. Provisional Application Ser. No. 62/947,271, filed Dec. 12, 2019 and U.S. Provisional Application Ser. No. 63/106,111, filed Oct. 27, 2020, the entire contents of which are hereby incorporated by reference in their entirety.

TECHNICAL FIELD

The present disclosure generally relates to work stations. More particularly, the present disclosure relates to work stations that may be reconfigured for storage and/or height.

BACKGROUND

The growing demand for a dynamic workplace setup stems from many end markets and use cases. A typical workspace includes a multi-monitor computer interface and an organized space to consult physical documents. There are currently products on the market that seek to offer modern workspace solutions, but the prior art does not enable a user to effectively increase his or her floor space while also protecting and storing away equipment when it is not in use.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a work station includes a base and a work surface pivotally mounted to the base so as to be configured to pivot between a first position and a second position. The work surface is configured to cover a protected member when in the first position and the work surface is configured to uncover the protected member when moved into the second position. The base is configured to support the work surface on a floor surface.

In another aspect, a work station includes a base. The work station also includes a work surface having a shielding member and at least one arm. The shielding member is pivotally joined to the at least one arm, and the at least one arm is pivotally mounted to the base at a first end portion of the at least one arm. The base is configured to support the work surface on a floor surface. The work station also has a bar mounted to the base. The bar is configured to receive a protected member. The work surface is movable between a first position in which the shielding member covers the protected member and a second position in which the work surface extends parallel to the floor surface, so that the protected member is uncovered.

In yet another aspect, a work station includes a base having a track configured to receive a slideable accessory.

The slideable accessory is configured to move upward and downward along the track. The accessory is configured to detachably lock in at least one position along the track. The slideable accessory is configured to support a protected member. The work station also includes a work surface pivotally mounted to the base so as to be configured to pivot between a first position and a second position. The work surface is configured to cover the protected member when in the first position and the work surface is configured to uncover the protected member when the work surface is moved into the second position. The base is configured to support the work surface on a floor surface. The work surface includes a table top such that when the work station is in the first position the table top spans the base and covers the protected member, and when the work station is in the second position the table top is positioned such that the protected member is uncovered.

In another aspect, a work station includes a stationary base and a movable upper frame. The movable upper frame can be raised and lowered through actuation of a motor within the stationary base. A work surface coupled to the movable upper frame is configured to pivot between a first position and a second position. The work surface and the frame are configured to cover a protected member within the frame when the work surface is in the first position. When the work surface is in the second position, the protected member is uncovered and a top of the work surface functions as a table top. The stationary base is configured to be mounted to a wall to support the movable upper frame.

In another aspect, a work station includes a stationary base and a movable upper portion. The movable upper portion can be raised and lowered through actuation of a motor within the stationary base. A work surface coupled to the movable upper portion is configured to pivot between a first position and a second position. A pair of wings are pivotally coupled to opposing ends of the work surface and can be extended to increase a length of the work surface when in the second position. The wings are configured to fold toward a wall and rest on a top surface of the stationary base when the work surface is in the first position. When in the open position, the wings can be left undeployed so that they contact a front surface of the legs for support of the work surface. The stationary base is configured to be mounted to a wall to support the movable upper portion.

DETAILED DESCRIPTION

Figures 1A, 1B, 1C, 1D, 1E:
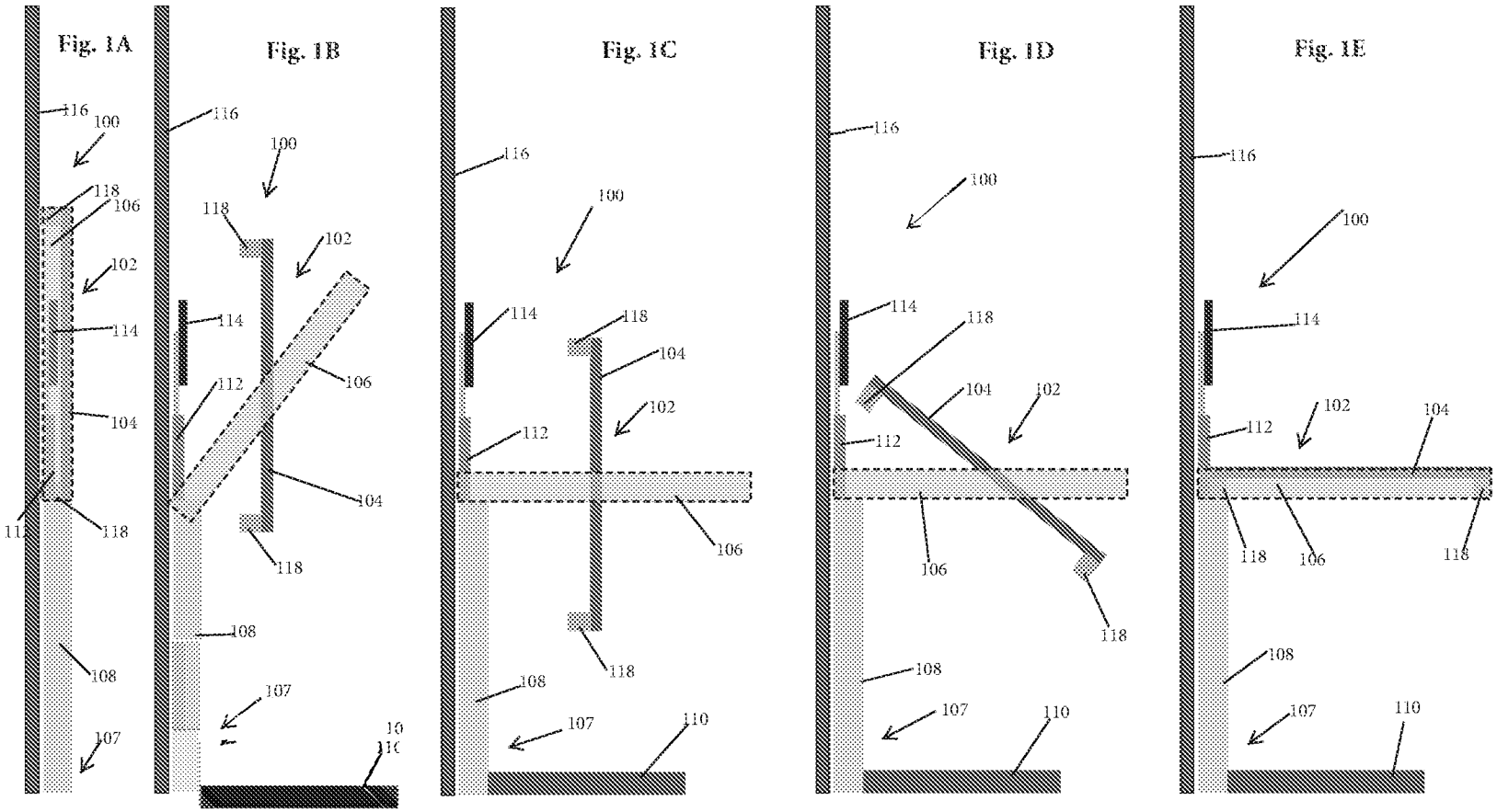
FIGS. 1A-1E provide a side view of an embodiment of a work station in accordance with the present disclosure, showing the work station moving sequentially from a first position (FIG. 1A) through intermediate steps (FIGS. 1B, 1C, 1D) to a second position (FIG. 1E)

The embodiments disclosed herein are for the purpose of providing a description of the present subject matter, and it is understood that the subject matter may be embodied in various other forms and combinations not shown in detail. Therefore, specific embodiments and features disclosed herein are not to be interpreted as limiting the subject matter as defined in the accompanying claims.

In accordance with the disclosure, a work station features a surface that can be used as a work surface when down, then when folded up the surface serves as a shield, protecting the computer monitors in an enclosed space (pocket). As the population continues to grow, and the ability for technology to improve our productivity continues, there will be a growing need for an ergonomic solution that empowers users to leverage technology in their workspaces effectively while also increasing available floor space when the work station is not in use.

Work stations according to the present disclosure and their individual components may be variously configured without departing from the scope of the present disclosure, but in one exemplary embodiment a work station, indicated in general at 100, is configured as shown in FIGS. 1A-2D. The work station 100 includes a base 107 and a work surface, indicated in general at 102, pivotally mounted to the base 107 so as to be configured to pivot between a first position and a second position. The work surface 102 is configured to cover a protected member 114 when in the first position and the work surface 102 is configured to uncover the protected member 114 when moved into the second position. The base 107 is configured to support the work surface 102 on a floor surface.

Additionally, the base 107 may include at least one leg member 108 in order to support the work surface 102. The at least one leg member 108 may have a top end joined with a first end portion of the work surface 102 and a bottom end joined with a foot member 110. The foot member 110 may be moveable from an inward position where the foot 110 lies perpendicular to the bottom end of the at least one leg member 108 (shown in FIG. 2A), to an outward position where the foot 110 extends parallel to the bottom end of the at least one leg member 108 (shown in FIGS. 1B-1E and 2C-2E). The foot 110 supports the leg member 108 on the floor surface.

As shown in FIGS. 1A-1E, the base 107 is configured to support the protected member 114 and may include a bar 112 configured to support the protected member. However, in alternative embodiments the protected member may be on a wall or disconnected from the base 107 and mounted directly to the wall. In FIGS. 1A-1E, the protected member 114 includes at least one monitor. However, the protected member 14 may also include or be any other appropriate item. When the work station 100 is in the first position (FIG. 1A), the work surface 102 extends perpendicular to the floor surface. When the work station 100 is in the second position (FIG. 1E) the work surface 102 extends parallel to the floor surface.

The work surface 102 may include a shielding member 104 joined to at least one arm 106. The at least one arm 106 is pivotally mounted to the base 107. The shielding member 104 may be configured to move in concert with the at least one arm 106. The shielding member 104 also may be configured to rotate relative to the at least one arm 106. The shielding member 104 may also include at least one bumper 118. As shown in FIG. 1, the shielding member 104 includes two bumpers 118 attached to each end portion of the shielding member 104. The bumpers 118 serve as a buffer between the shielding member 104 and a wall 116, cushioning the shielding member 104 as it contacts the wall 116. When the work station 100 in the first position (FIG. 1A), the protected member 114 sits between the wall 116 and the shielding member. The work surface 102 and/or the at least one leg member 108 may be configured to detachably connect to the wall 116 when in the first position. The detachable connection may be via a hook or other appropriate connector used to securely fasten the work station 100. The at least one leg member 108 may be connected to the wall 116 in the first position (FIGS. 1A, 2A), during the intermediate steps (FIGS. 1B-1D, 2B-2C), or in the second position (FIGS. 1E, 2D) to increase support for the work station 100. The at least one arm 106 may be connected to the wall 116 when the work station 100 is in the first position.

Figure 2A:
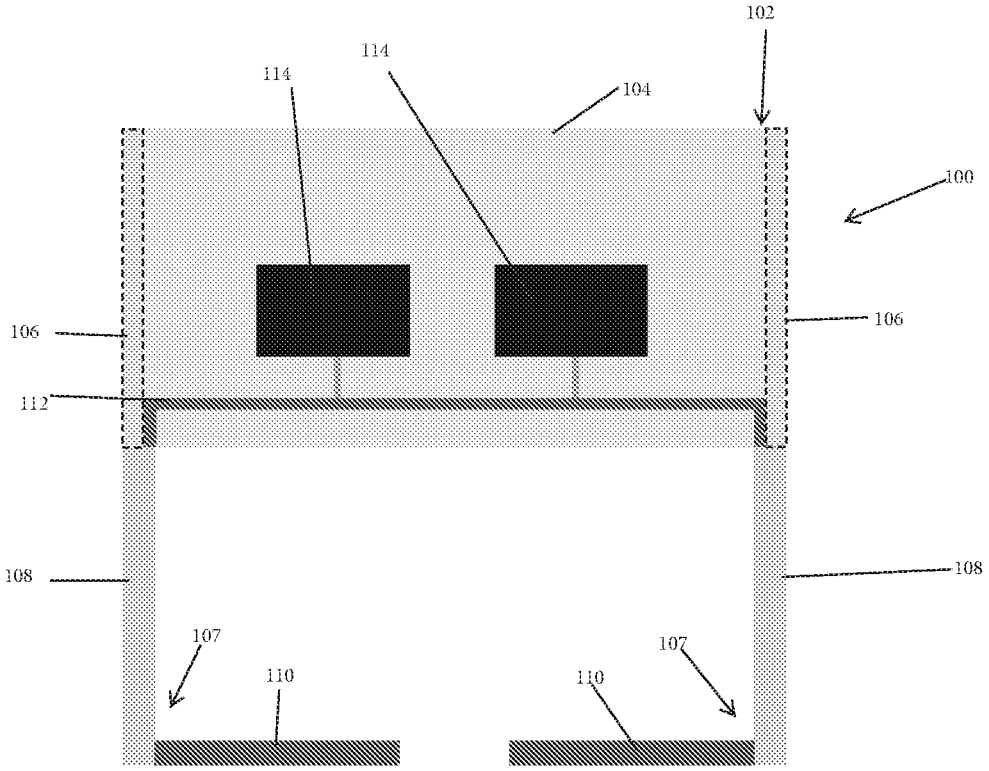
FIG. 2A is a front view of the work station of FIG. 1A.

FIG. 2A is a front view of the work station 100 of FIG. 1A. FIG. 2A shows the embodiment of the work station 100 in the first position. In the first position, the at least one arm 106 and the shielding member 104 are parallel to the wall. In the embodiment shown, the work station 100 includes two arms (a first arm and a second arm) 106. In alternative embodiments other appropriate numbers of arms may be used. The first arm 106 contacts a first side of the shielding member 104 and the second arm 106 contacts a second side of the shielding member 104. The at least one arm 106 supports the shielding member 104, and helps hold the shielding member 104 in the first position. Additionally, as shown in FIG. 2A the work station 100 includes at least one foot 110 and at least one leg 108. To increase support and stability of the work station 100, when in the first position, the at least one foot 110 is positioned perpendicular to the at least one leg 108.

Figure 2B:
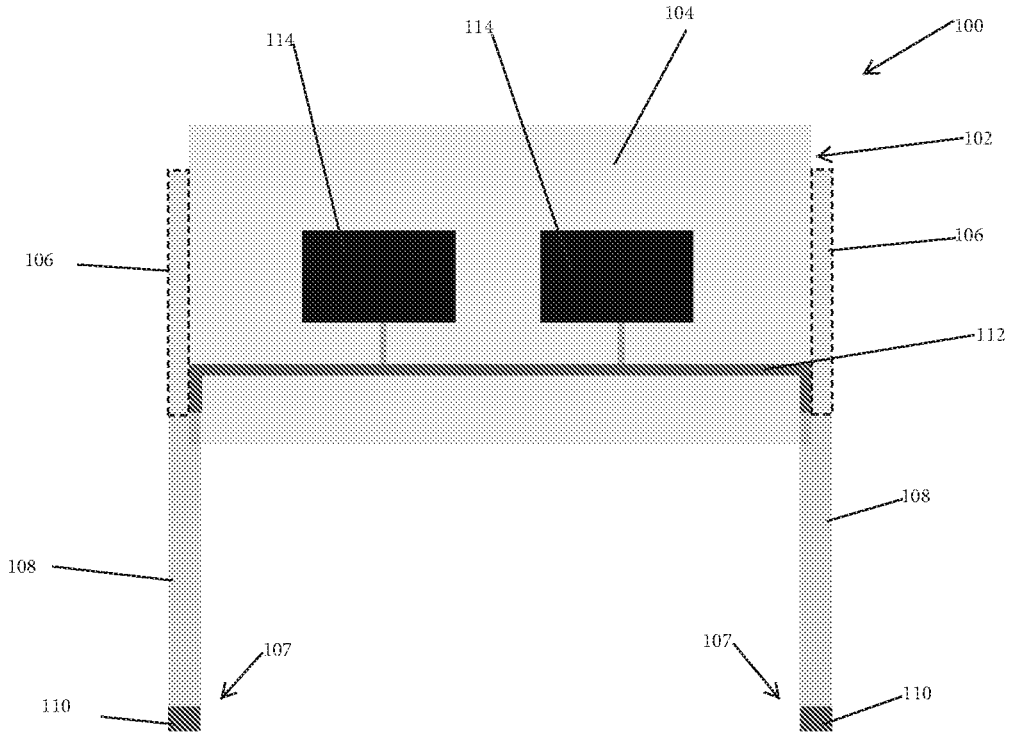
FIG. 2B is a front view of the work station of FIG. 1B.

FIG. 2B is a front view of the work station 100 of FIG. 1B. FIG. 2B shows a first intermediate step of moving the work station 100 from the first position to the second position. During the first intermediate step, the at least one foot 110 is moved perpendicular to the at least one leg 108, and the at least one arm 106 is moved toward its horizontal configuration (parallel to the floor surface). FIG. 2B shows the at least one arm 106 projecting moderately outward relative to the shielding member 104.

Figure 2C:
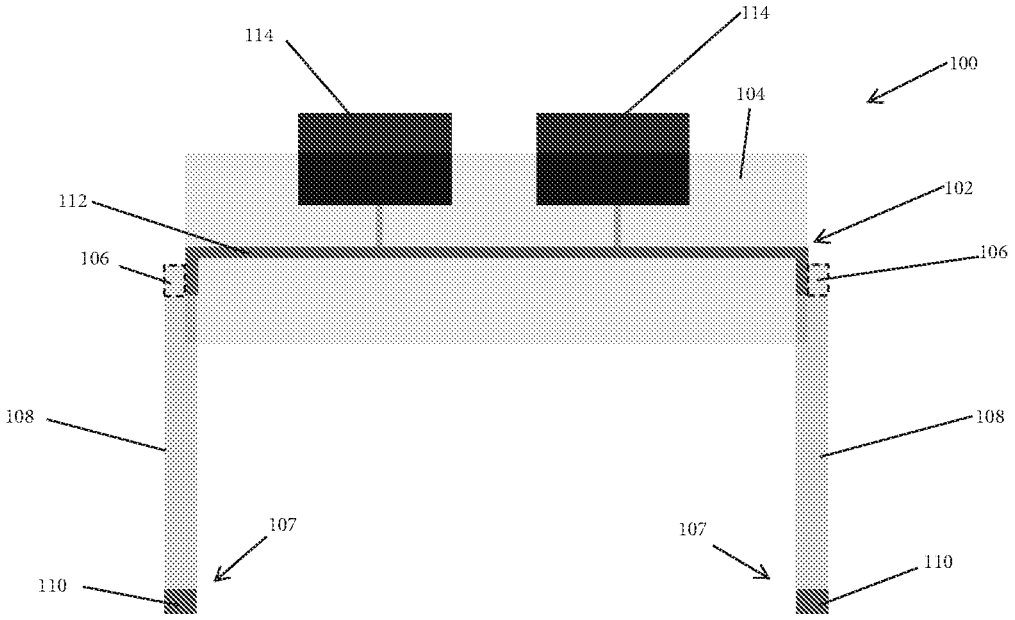
FIG. 2C is a front view of the work station of FIG. 1D.

FIG. 2C is a front view of the work station 100 of FIG. 1D. FIG. 2C shows a third intermediate step of moving the work station 100 from the first position to the second position. (The second intermediate step is portrayed in FIG. 1C where the shielding member 104 is shown positioned perpendicular to the at least one arm 106. The at least one arm 106 is positioned in the horizontal configuration, parallel to the floor surface.) During the third intermediate step, the shielding member 104 is rotated toward the plane of the at least one arm 106 (parallel to the floor surface) and the protected member 114 is gradually uncovered. As shown in 1D, the rotation of the shielding member 104 may be counter-clockwise. In alternative embodiments, the shielding member 104 may be rotated clockwise.

Figure 2D:
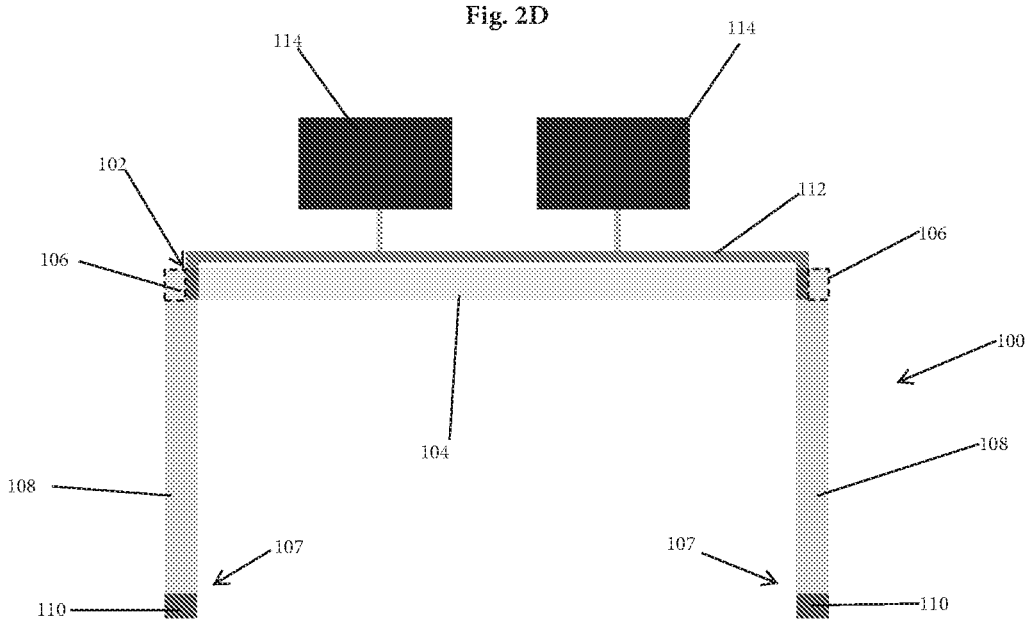
FIG. 2D is a front view of the work station of FIG. 1E.
Figure 2E:
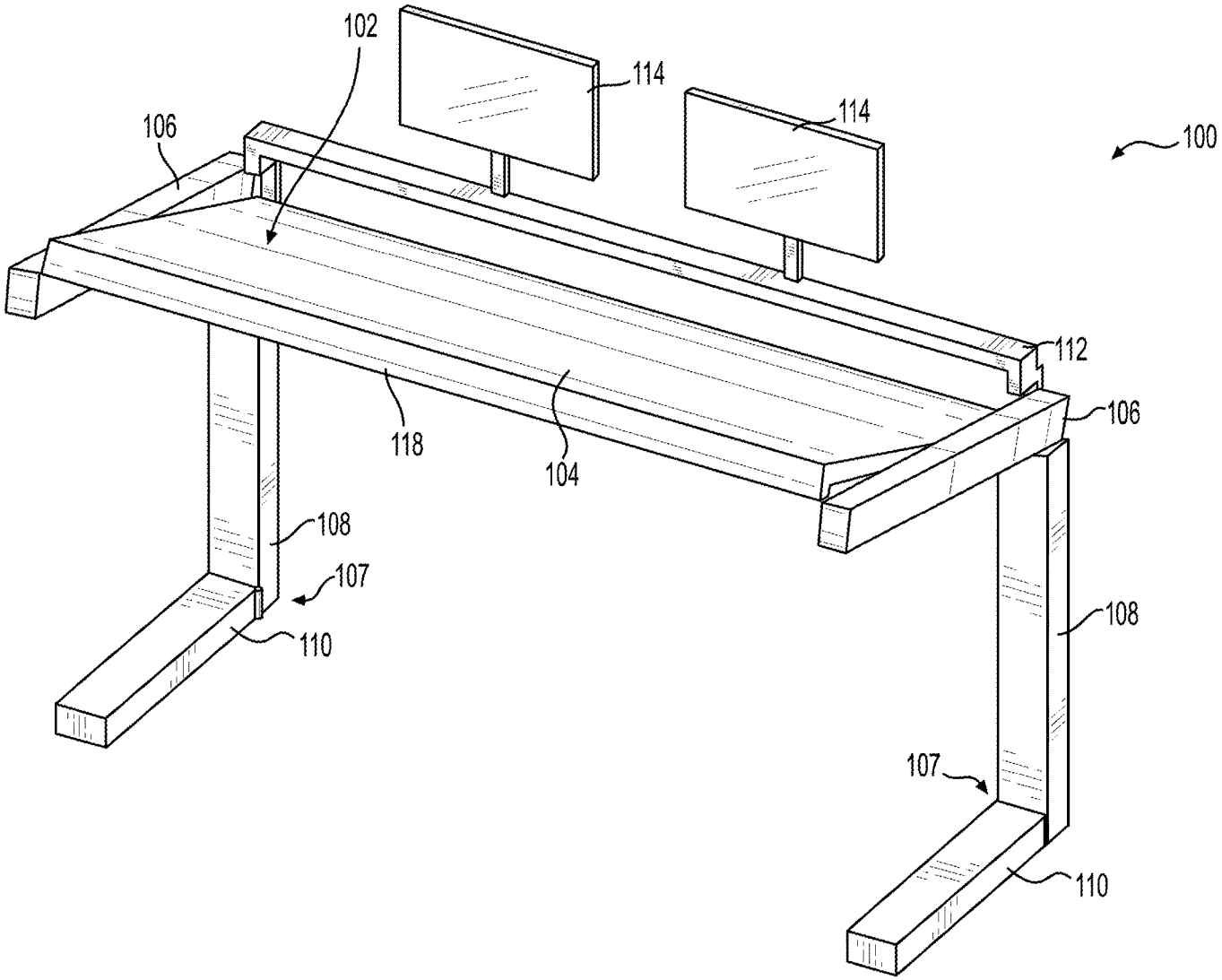
FIG. 2E is a perspective view of the work station of FIGS. 1A-1E.

FIG. 2D is a front view of the work station of FIG. 1E. FIG. 2D shows the work station 100 in the second position. When in the second position the shielding member 104 is positioned planar to the at least one arm 106. The work surface 102 sits parallel to the floor surface and perpendicular to the base 107. When the work station 100 is in the second position a user has a flat and stable work surface 102 on which to work. Additionally, the protected member 114 is uncovered and fully visible. In the embodiment shown, the protected member includes two monitors. Thus, a user may view the two monitors while working on the work surface 102.

Next, FIGS. 3A-4D illustrate an embodiment of a work station, indicated in general at 200. The work station 200 includes a base 207 and a work surface 202. The work surface 202 has a shielding member 204 and at least one arm 206 where the shielding member 204 is pivotally joined to the at least one arm 206, and the at least one arm 206 is pivotally mounted to the base 207 at a first end portion of the at least one arm 206. In the embodiment shown in FIGS. 3A-4C the shielding member 204 is joined to the at least one arm 206 and the shielding member 204 and the at least one arm 206 move together. The base 207 is configured to support the work surface 202 on a floor surface and may include at least one leg member 208 joined to at least one foot member 210. A support member 212 is mounted to the base 207. As shown in FIGS. 3A-4D the support member 212 may be a bar. The support member 212 is configured to receive a protected member 214. The work surface 202 is movable between a first position in which the shielding member 204 covers the protected member 214 (shown in FIGS. 3A and 4A) and a second position in which the work surface 202 extends parallel to the floor surface so that the protected member 214 is uncovered.

Furthermore, the work surface 202 and/or the at least one leg member 208 may be configured to detachably connect to a wall 216. The detachable connection may be made with a hook or other appropriate connector. The at least one leg member 208 may be connected to the wall 216 in the first position (FIGS. 3A, 4A), during the intermediate steps (FIGS. 3B-3D, 4B-4C), or in the second position (FIGS. 3E, 4D) to increase support for the work station 200. The at least one arm 206 may be connected to the wall 216 when the work station 200 is in the first position.

Figures 3A, 3B, 3C, 3D, 3E:
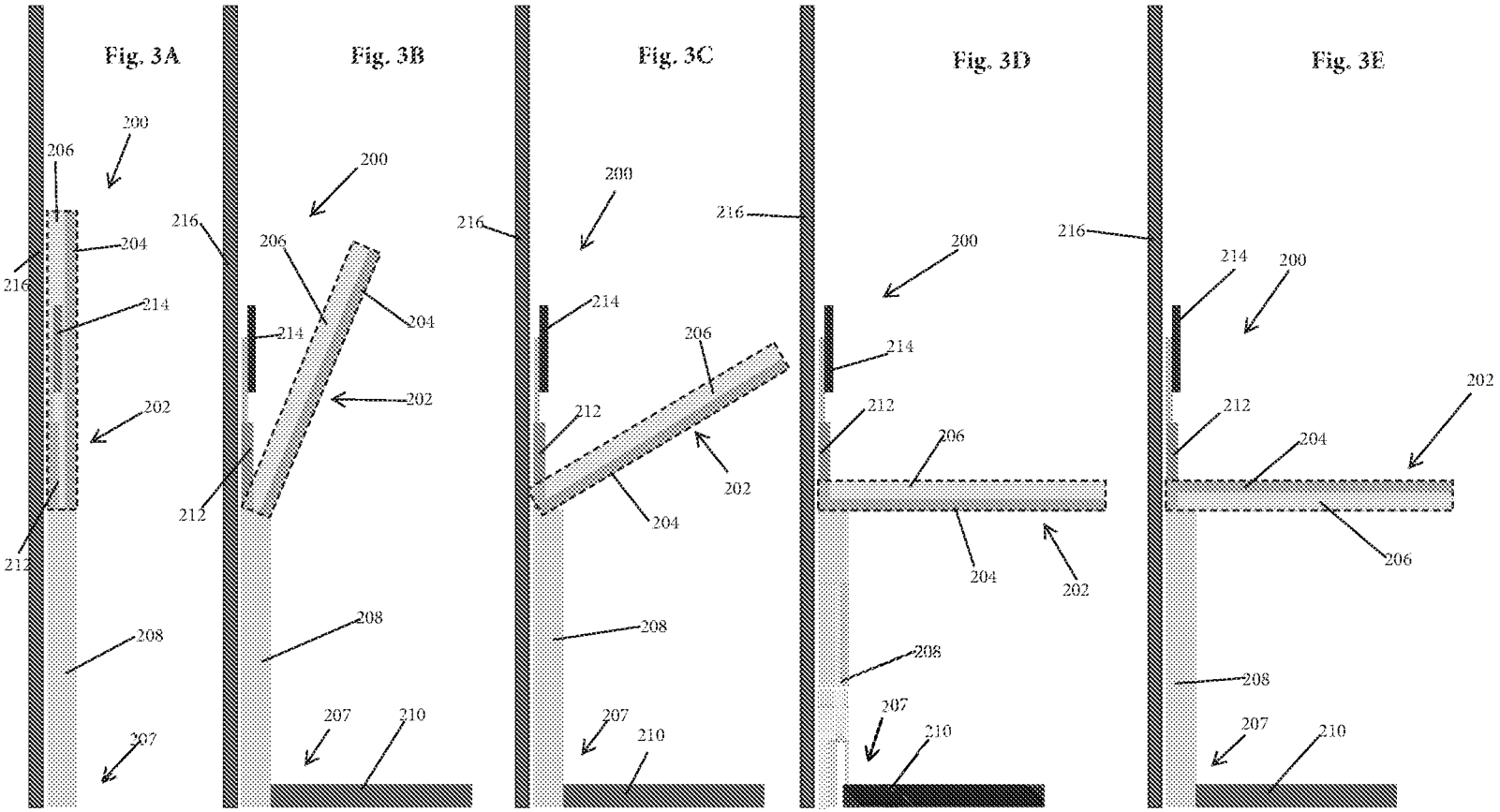
FIGS. 3A-3E provide a side view of an embodiment of a work station in accordance with the present disclosure, showing the work station moving sequentially from a first position (FIG. 3A) through intermediate steps (FIGS. 3B, 3C, 3D) to a second position (FIG. 3E)
Figure 4A:
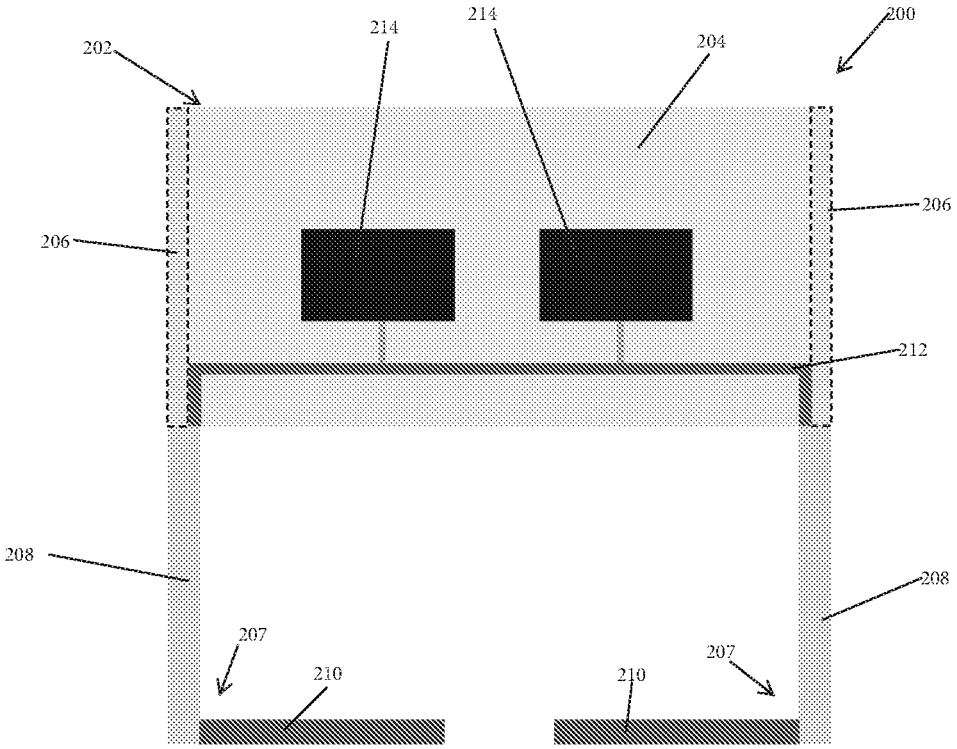
FIG. 4A is a front view of the work station of FIG. 3A.

FIG. 4A is a front view of the work station 200 of FIG. 3A. FIG. 4A shows the embodiment of the work station 200 in the first position. When in the first position, the at least one arm 206 and the shielding member 204 are parallel to the wall. As shown the embodiment illustrated in FIG. 4A, the work station 200 may include two arms (a first arm and a second arm) 206. The first arm 206 contacts a first side of the shielding member 204 and the second arm 206 contacts a second side of the shielding member 204. The at least one arm 206 supports the shielding member 204, and helps hold the shielding member 204 in the first position. Additionally, as shown in FIG. 4A the work station may include at least one foot 210 and at least one leg 208. To increase support and stability of the work station 200, when in the first position, the at least one foot 210 is positioned perpendicular to the at least one leg 208.

Figure 4B:
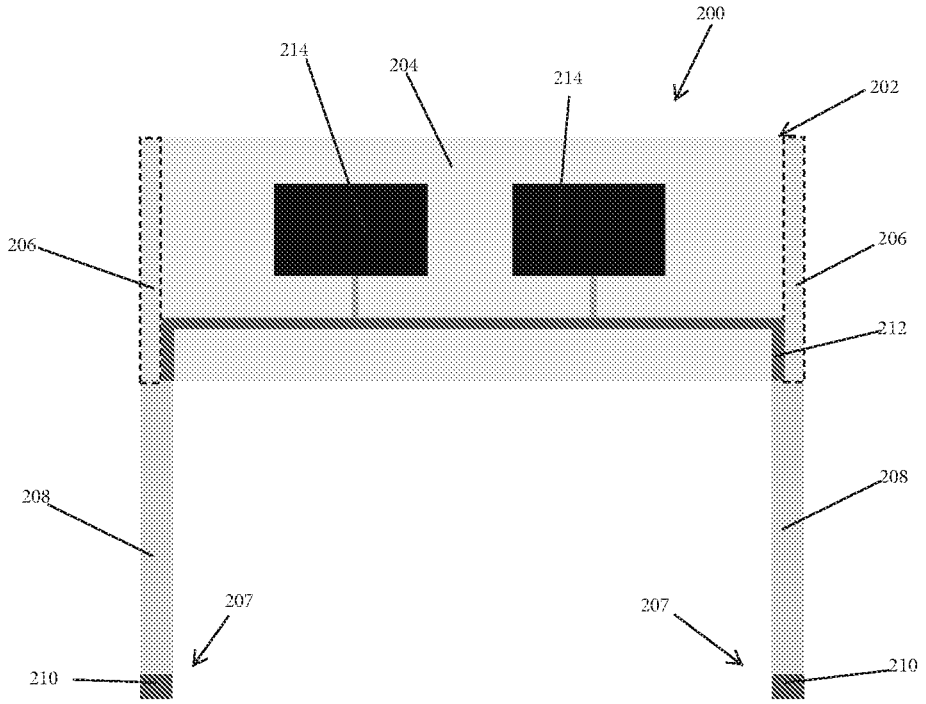
FIG. 4B is a front view of the work station of FIG. 3B.
Figure 4C:
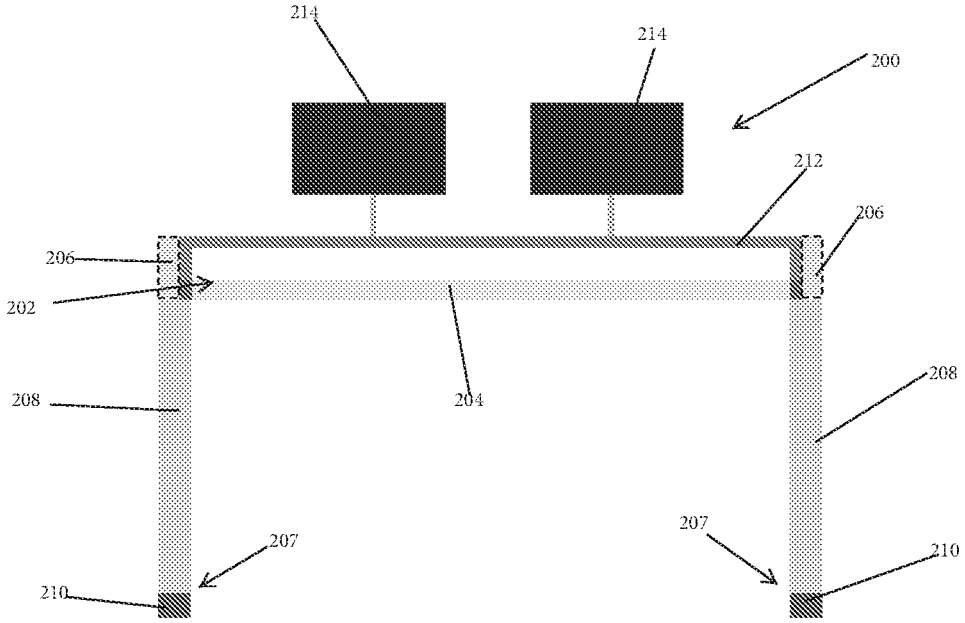
FIG. 4C is a front view of the work station of FIG. 3D.

FIGS. 4B and 4C are front views of the work station 200 of FIGS. 3B and 3D respectively. FIGS. 4B and 4C show intermediate steps of moving the work station 200 from the first position to the second position. During the first intermediate step (shown in 4B), the at least one foot 210 is moved perpendicular to the at least one leg 208. As shown in FIGS. 3B-3D and FIGS. 4B-4C, during the intermediate steps, the at least one arm 206 and the shielding member 204 move together. FIG. 4B shows the work surface 202 projecting moderately outward relative to the base 207. FIG. 4C shows the at least one arm 206 and the shielding member 204 fully extended. In FIG. 4C the shielding member 204 sits low relative to the at least one arm 206.

Figure 4D:
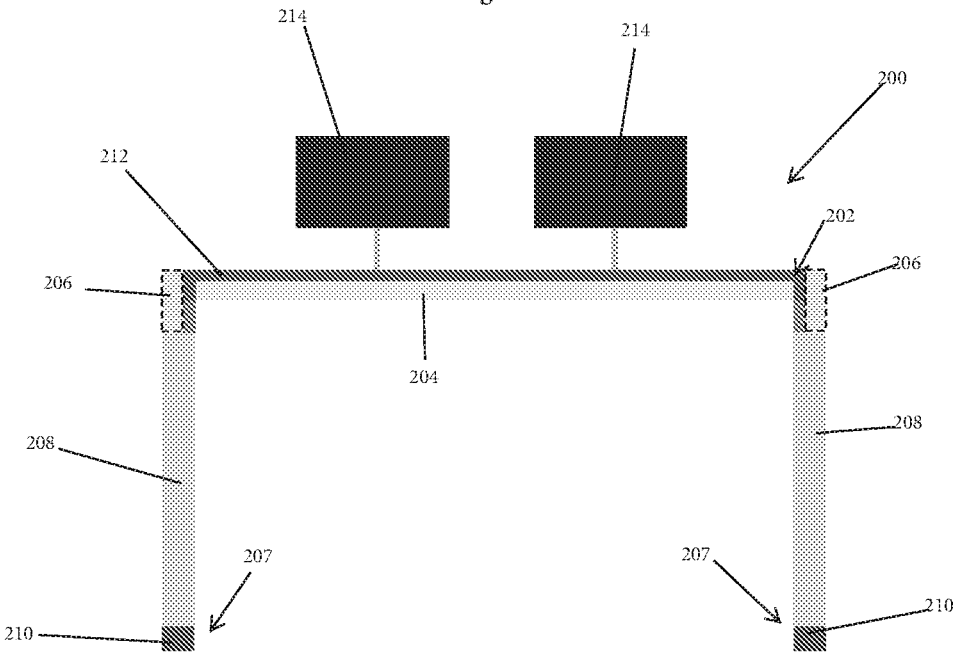
FIG. 4D is a front view of the work station of FIG. 3E.
Figure 4E:
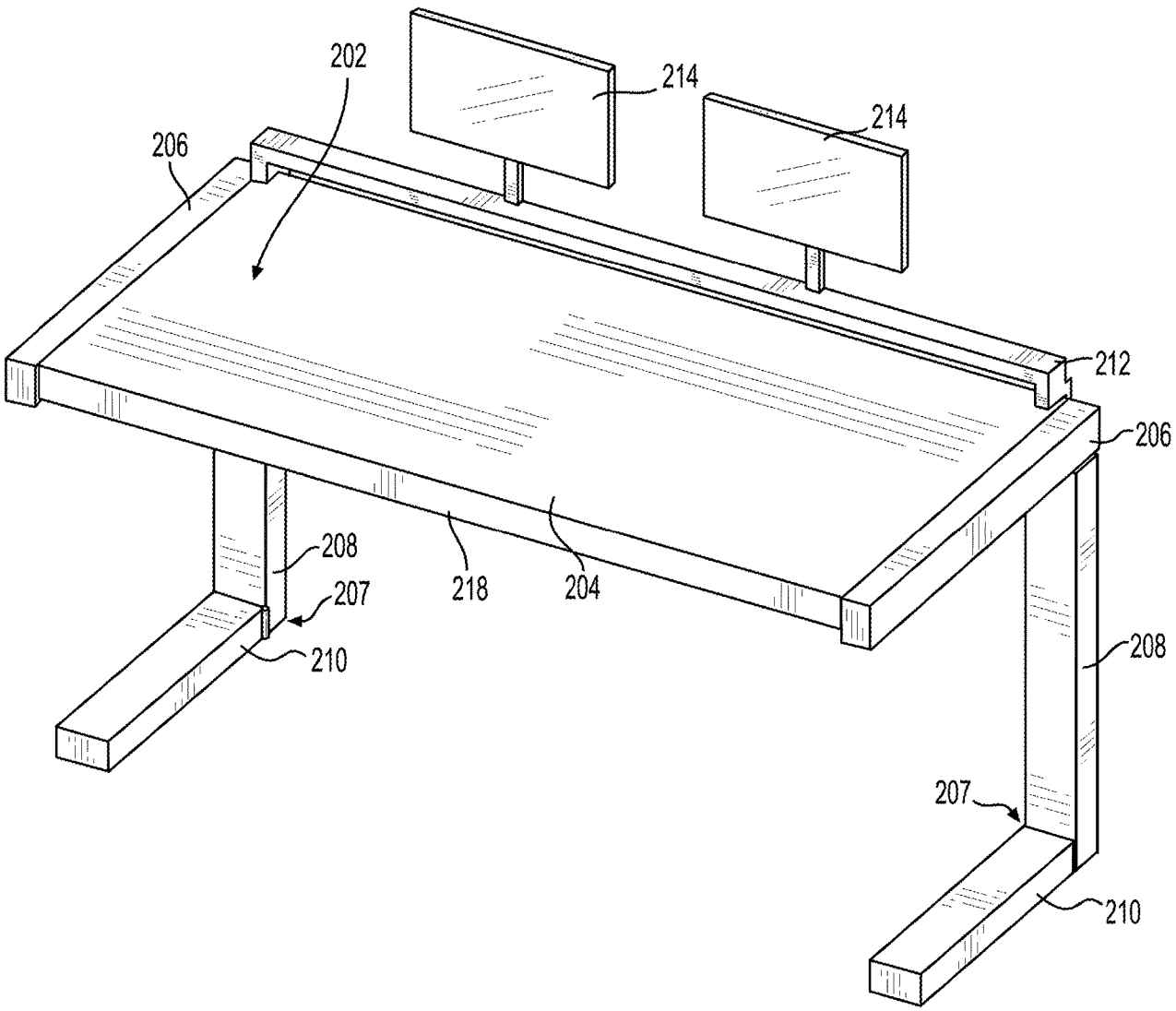
FIG. 4E is a perspective view of the work station of FIGS. 3A-3E.

When moved to the second position, as shown in FIGS. 3E and 4D, the shielding member 204 sits planar to the at least one arm 206. When in the second position, the work surface 202 sits parallel to the floor surface and perpendicular to the base 207. When the work station 200 is in the second position a user has a flat and stable work surface 202 on which to work. Additionally, the protected member 214 is uncovered and fully visible. In the embodiment shown, the protected member includes two monitors. Thus, a user may view the two monitors while working on the work surface 202.

FIGS. 5A-6D show an embodiment of a work station 300 comprising a base 307 having a leg 308 including a track 320 configured to receive a slideable accessory 312. The track 320 is visible in FIGS. 5D-6D. As shown, the slideable accessory 312 may be a bar. The slideable accessory 312 is configured to move along the track 320. The accessory 312 is configured to detachably lock in at least one position along the track 320. The slideable accessory 312 is configured to support a protected member 314. In the embodiment shown, the protected member 314 includes at least one monitor. In alternative embodiments the protected member may also be any other appropriate item. The sliding mechanism allows the protected member 314 to change positions.

The work station 300 also includes a work surface 302 pivotally mounted to the base 307 so as to be configured to pivot between a first position and a second position. The work surface 302 is configured to cover the protected member 314 when in the first position (shown in FIGS. 5A, 6A) and the work surface 302 is configured to uncover the protected member 314 when the work surface 302 is moved into the second position (shown in FIGS. 5F, 6D). The work surface 302 may extend to a floor surface. The base 307 is configured to support the work surface 302 on the floor surface. The work surface 302 includes a table top 304 such that when the work station 300 is in the first position the table top 304 spans the base 307 and covers the protected member 314, and when the work station 300 is in the second position the table top 304 is positioned such that the protected member 314 is uncovered.

As shown in FIGS. 5A-6D, the base 307 may include the at least one leg 308 and at least one foot 310. The at least one foot 310 is attached to an end portion of the at least one leg 308. The work surface 302 may include a slot 306 configured to receive the table top 304. When the work surface 302 is in the first position the table top 304 sits outside the slot 306. When the work surface 302 is in the second position the table top 304 sits inside the slot 306. Additionally, the slideable accessory 312 may be configured so that the protected member 314 sits between the table top 304 and a wall 316 when the work surface 302 is in the first position and the protected member 314 sits above the table top 304 when the work surface 302 is in the second position.

Additionally, the base 307 may be configured to detachably connect to a wall 316. The detachable connection may be via a hook or other appropriate connector. The connection may be made by a mechanical bond, an adhesive bond or other appropriate mechanisms known to one of ordinary skill. The base 307 may be connected to the wall 316 in the first position (FIGS. 5A, 6A), during the intermediate steps (FIGS. 5B-5D, 6B-6C), or in the second position (FIGS. 5E, 6D) to increase support for the work station 300.

Figures 5A, 5B, 5C, 5D, 5E, 5F:
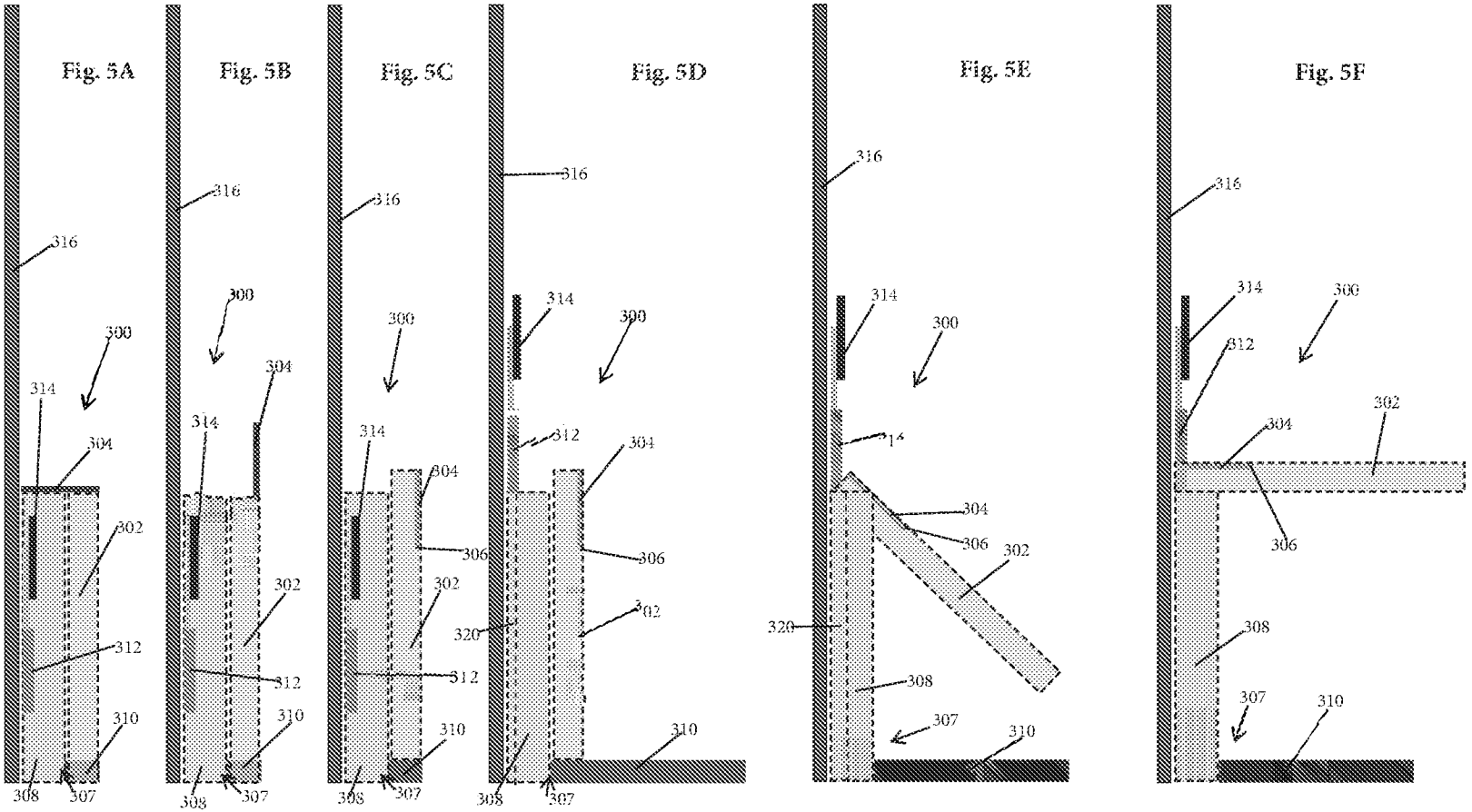
FIGS. 5A-5F provide a side view of an embodiment of a work station in accordance with the present disclosure, showing the work station moving sequentially from a first position (FIG. 5A) through intermediate steps (FIGS. 5B, 5C, 5D, 5E) to a second position (FIG. 5F)
Figure 6A:
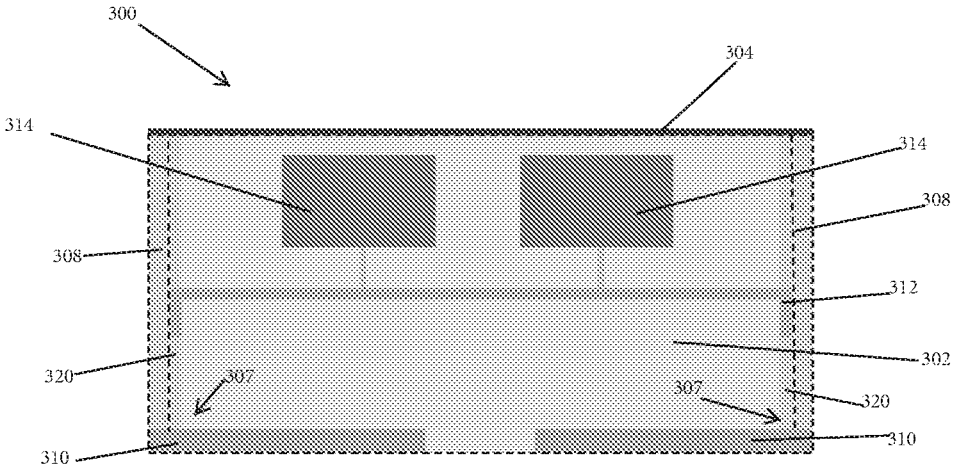
FIG. 6A is a front view of the work station of FIG. 5A.

FIG. 6A is a front view of the work station 300 of FIG. 5A. As shown in FIG. 6A when the work station 300 is in the first position, the at least one foot member 310 sits perpendicular to the at least one leg member 308. This increases stability and support for the work station 300. Additionally, as shown in FIGS. 6A-6D, the protected member 314 may include two monitors.

Figure 6B:
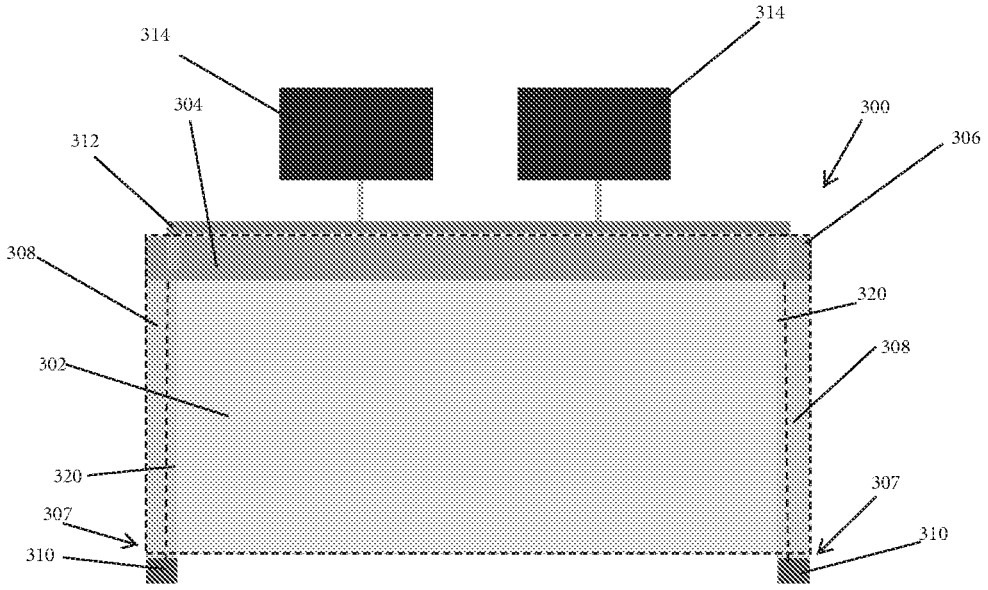
FIG. 6B is a front view of the work station of FIG. 5D.

FIG. 6B is a front view of the work station 300 of FIG. 5D. FIG. 6B shows the work station 300 during a third intermediate step. (The work station 300 during a first intermediate step is shown in FIG. 5B; the table top is tilted vertically in preparation for insertion into the slot 306. The work station 300 during a second intermediate step is shown in FIG. 5C. During the second intermediate step, the table top 304 is placed inside the slot 306 and the work surface 302 is raised above the at least one foot 310.) During the third intermediate step, the slideable accessory 312 is moved such that the protected member 314 is exposed. In the embodiment shown, the slideable accessory 312 is moved vertically to a top end of the at least one leg 308. Additionally, the at least one foot 310 is moved perpendicular to the at least one leg 308 in order to increase stability and support.

Figure 6C:
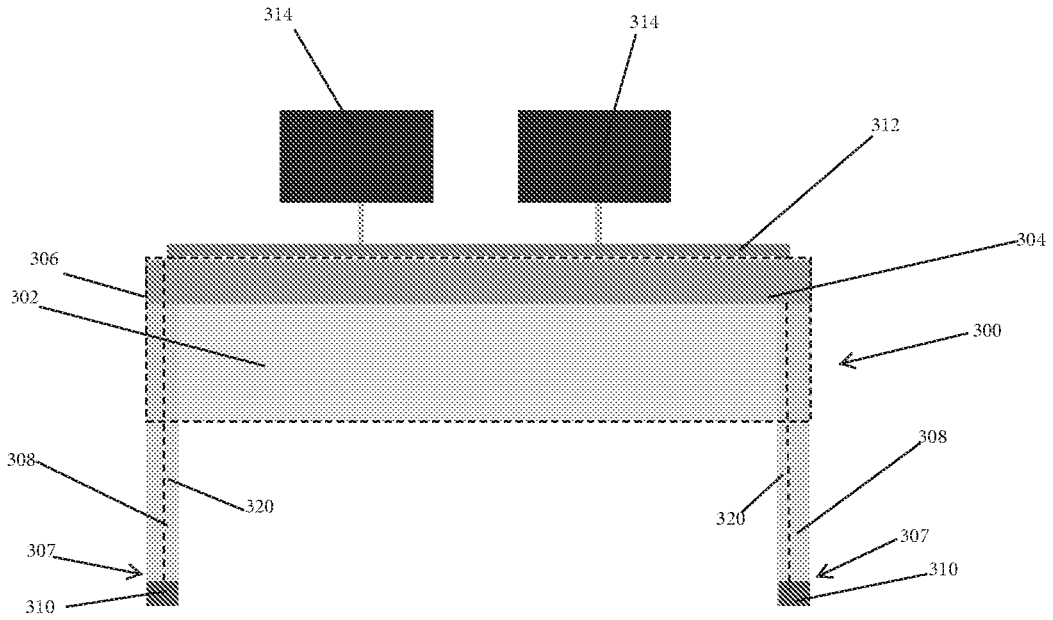
FIG. 6C is a front view of the work station of FIG. 5E.

FIG. 6C is a front view of the work station of FIG. 5E. FIG. 6C shows the work station 300 during a fourth intermediate step. In the fourth step, the work surface 302 rotates from the vertical configuration of the first position to the horizontal configuration of the second position.

Figure 6D:
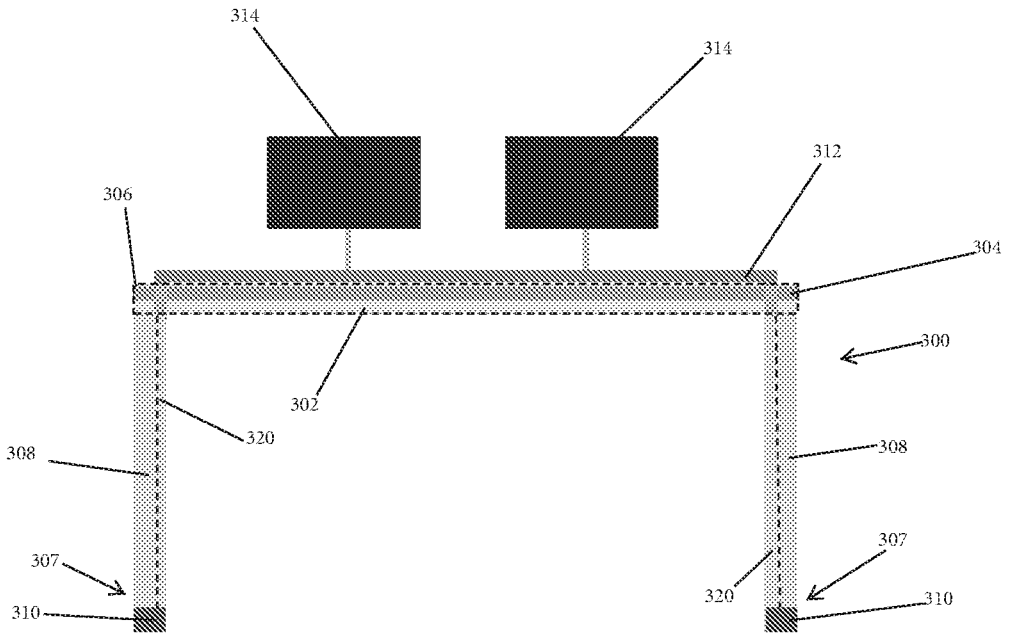
FIG. 6D is a front view of the work station of FIG. 5F.
Figure 6E:
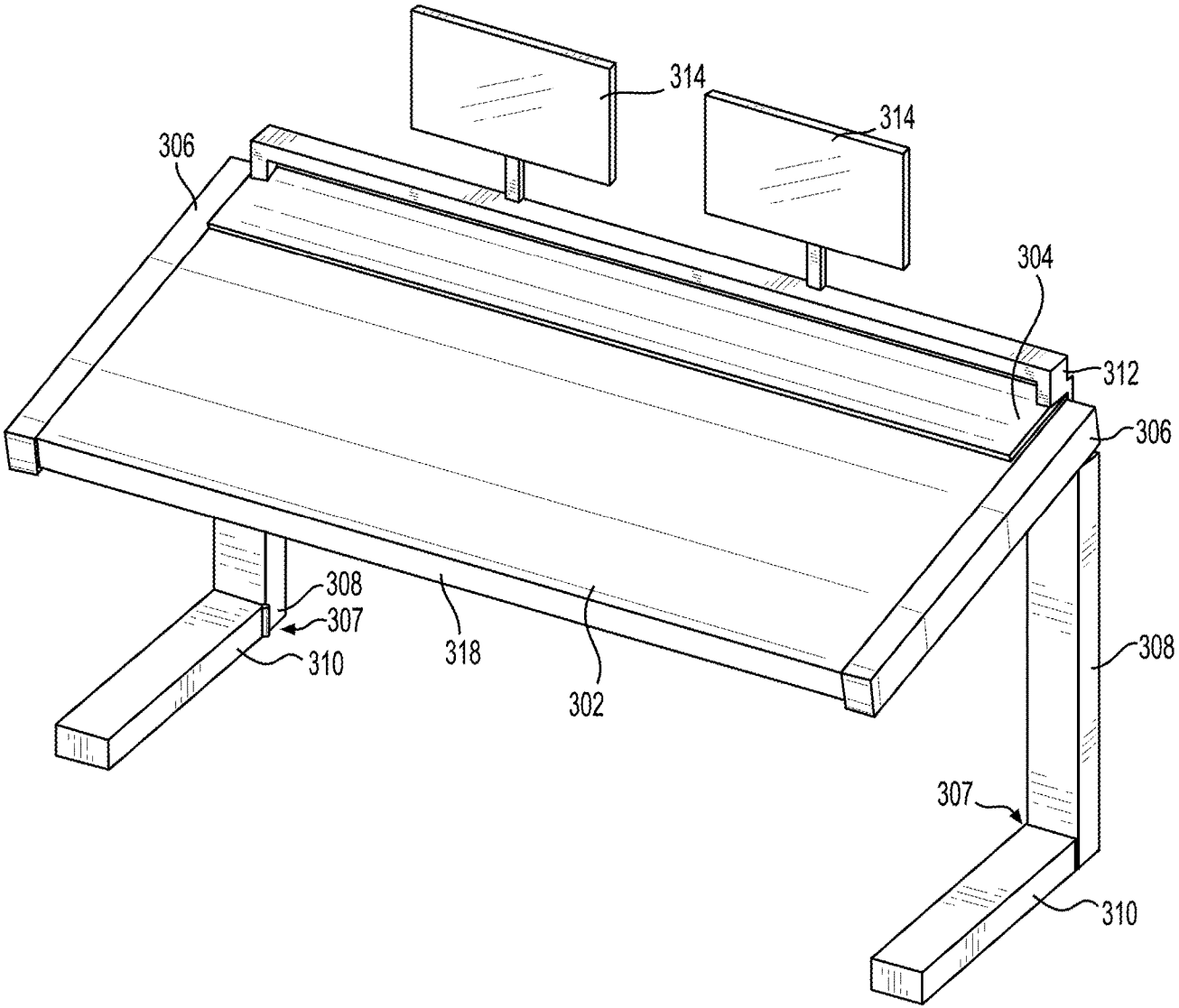
FIG. 6E is a perspective view of the work station of FIGS. 5A-5F.

FIG. 6D is a front view of the work station of FIG. 5F. FIG. 6D shows the work station 300 in the second position. When in the second position, the work surface 302 sits parallel to the floor surface and perpendicular to the base 307. When the work station 300 is in the second position a user has a flat and stable work surface 302 on which to work. Additionally, the protected member 314 is uncovered and fully visible. In the embodiment shown, the protected member includes two monitors. Thus, a user may view the two monitors while working on the work surface 302.

Referring next to FIGS. 7A-7D, depicted is a work station 700. Work station 700 comprises a pair of parallel legs 108 joined by one or more cross beams 702. A movable upper frame 704 comprises a pair of supports 706 which are received within legs 108. As will be explained later, an actuating mechanism within legs 108 can move movable upper frame 704 between a retracted position, as shown in FIGS. 7A-7D, and an extended position, as shown in FIGS. 8A-8D. A top rail 708 extends across a top of movable upper frame 704 to join supports 706. A pair of arms 106 and work surface 102 are pivotally coupled to a supports 706, allowing the work surface 102 to be moved between a stowed position, as depicted in FIGS. 7A-7D, and a deployed position, as depicted in FIGS. 9A-9D.

The combination of arms 106 and work surface 102 preferably have a width and length such that they fully nest within movable upper frame 704 as depicted in FIGS. 7A-7D. This helps to maintain the work surface 102 in the stowed position, especially as movable upper frame 704 is raised or lowered. One or more securing members, such as latches or locks, may be coupled to movable upper frame 704 to prevent work surface 102 from inadvertently being deployed.

In some embodiments, work surface 102 may have a wider portion so that it does not nest within movable upper frame 704 and instead covers upper frame 704 such that only the underside of work surface 102 is visible from the front of work station 100 when work surface 102 is raised. A hook, latch, or other mechanism can be utilized to couple work surface 102 to upper frame 704 when work surface 102 is in the stowed position.

In this embodiment, work station 700 preferably comprises no legs 108. Instead, hardware is used for mount cross beam 702 to wall 116. For example, a plurality of hanger brackets may be placed on the wall and cross beam 702 may be "hung" from the hanger brackets. In another embodiment, hardware may be placed directly through cross beam 702 to secure cross beam 702 directly to the wall (e.g., to wall studs). One of ordinary skill in the art would recognize that there are multiple ways of securing cross beam 702 to wall 116.

In some embodiments, legs 108 can be suspended off the ground by mounting cross beam 702 at a higher position. This allows the work station 700 to appear to be "floating" and makes it easier to clean under the desk since legs 108 are not in contact with the ground.

Figure 7A:
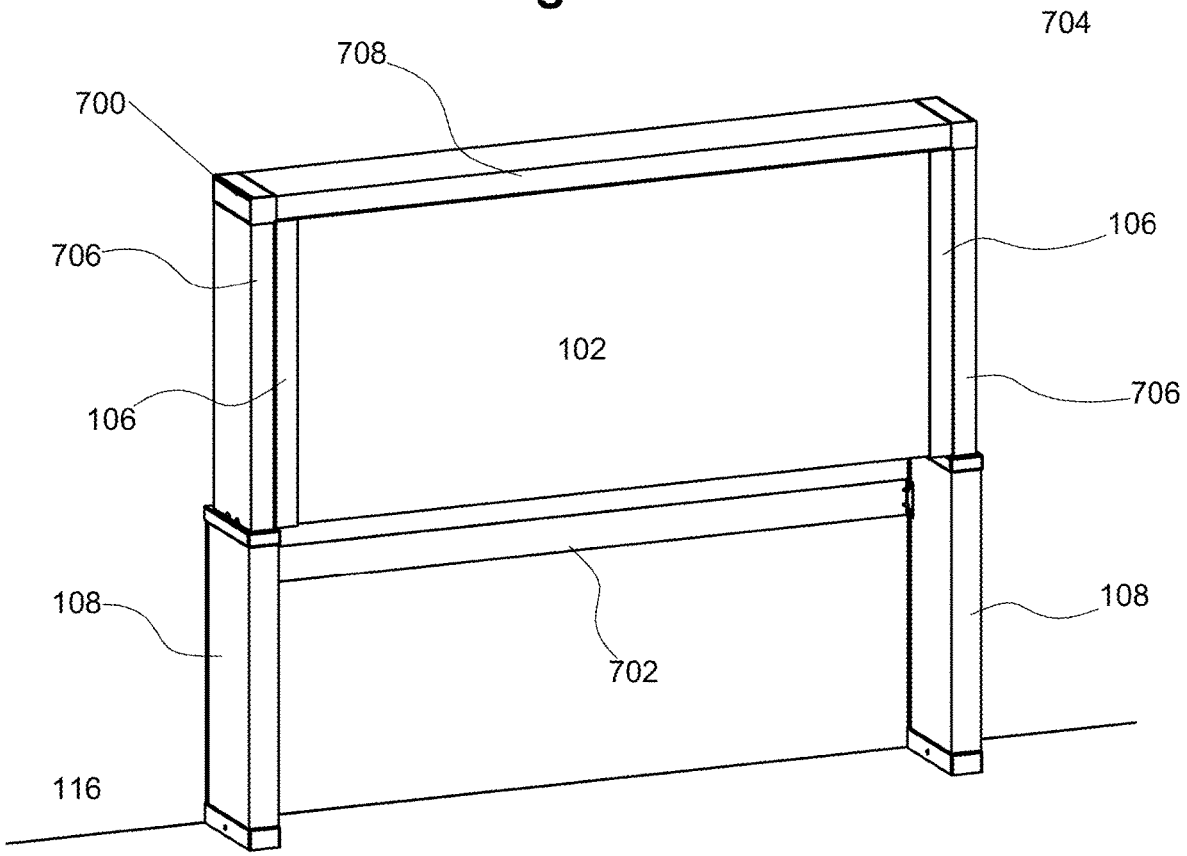
FIGS. 7A-7D depict views of an embodiment of a work station in a retracted and stowed position.
Figure 7B:
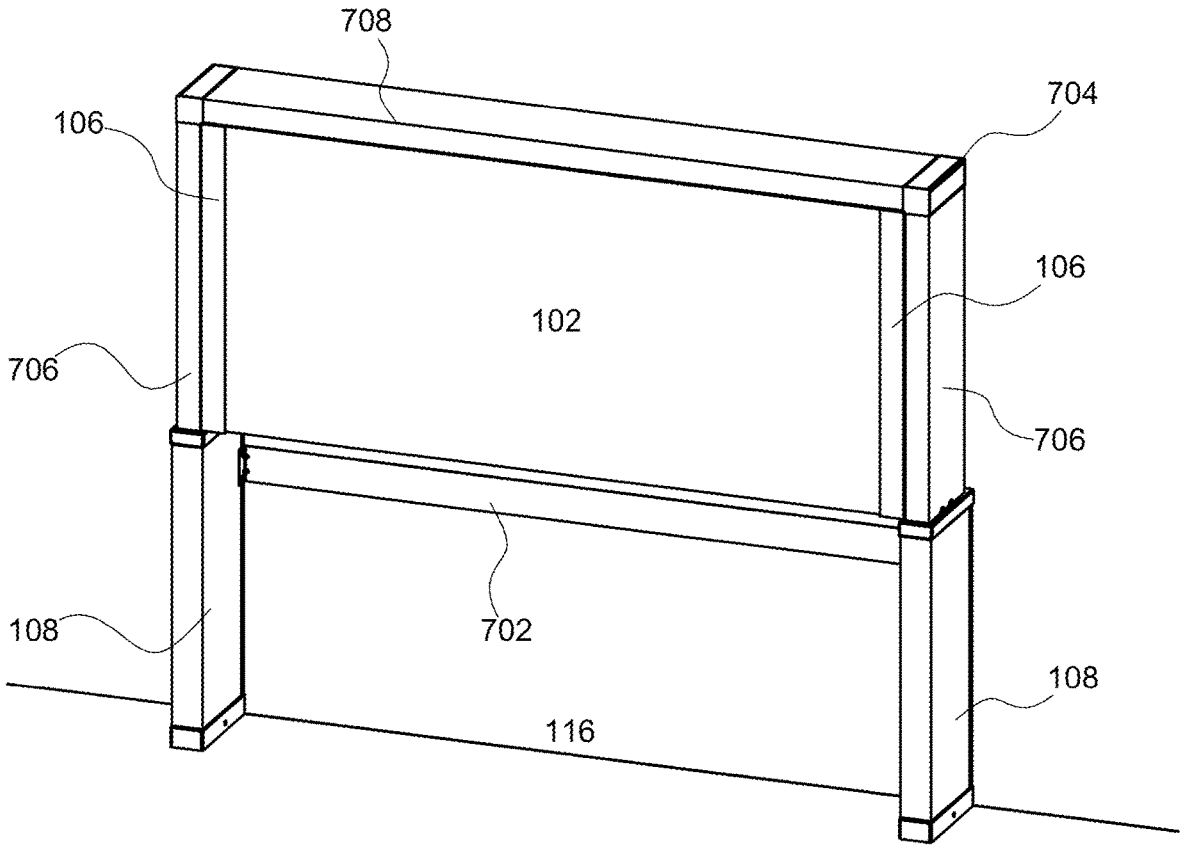
Figure 7D:
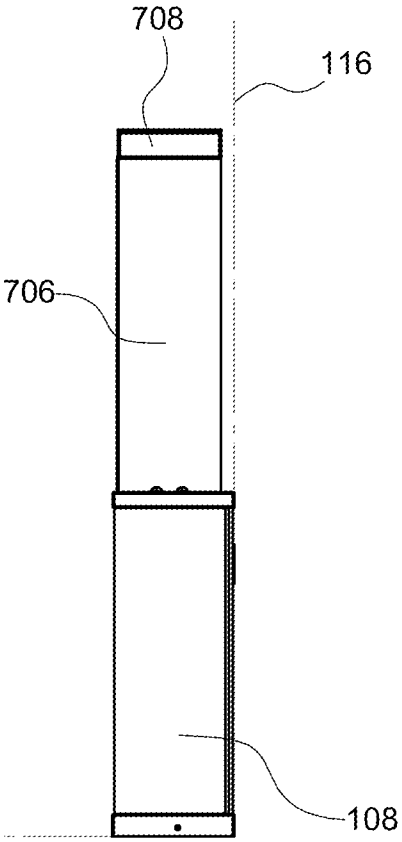
Figure 7C:
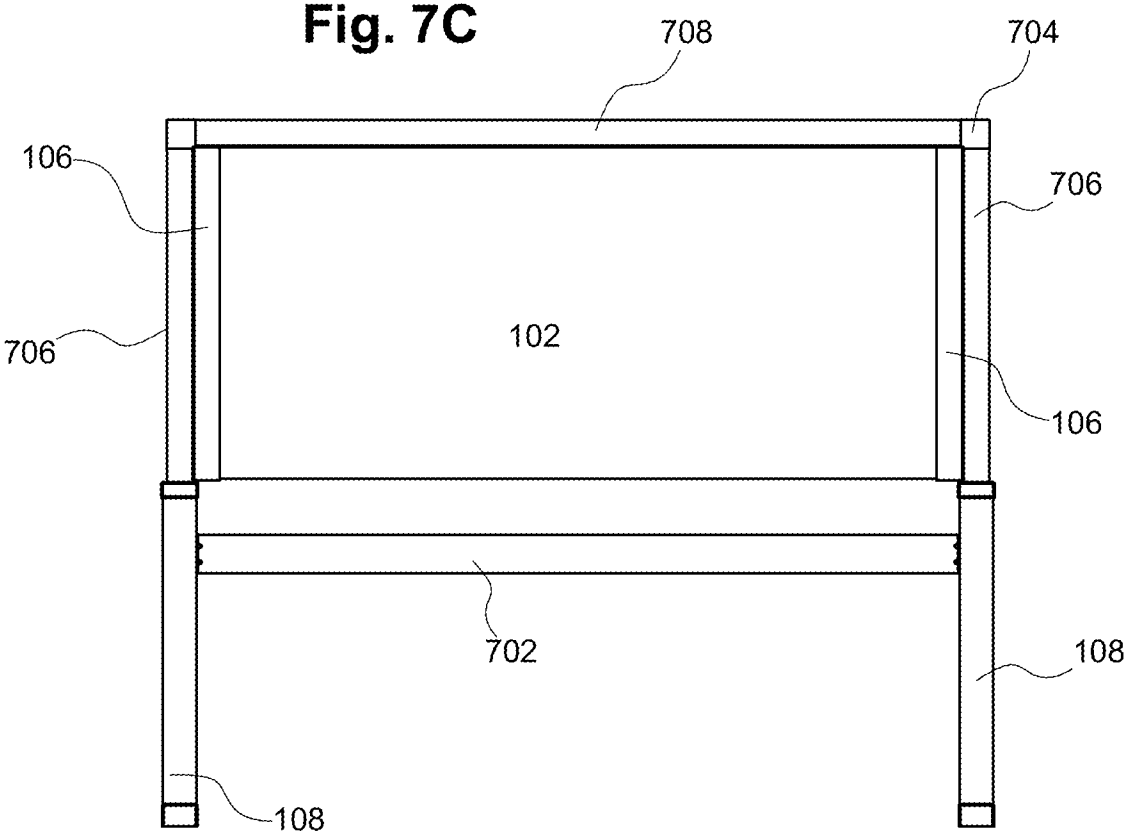

FIGS. 7C and 7D illustrate exemplary dimensions of work station 700 in the retracted position. As an example, work station 700 may have an overall height of 55-56" when in the retracted position. Further, as depicted in FIG. 7D, legs 108 preferable have a width approximately 1-1.5" greater than that of supports 706 to allow for a gap between wall 116 and supports 706. This gap allows for cords for electronics secured within movable upper frame 704 to be connected to wall outlets which are usually close to the ground (e.g., near legs 108). Further, this gap allows for free movement of movable upper frame 704 with respect to wall 116. It should be obvious to one of ordinary skill in the art that the dimensions described herein can be modified depending upon the uses or needs for work station 700.

FIGS. 8A-8D depict work station 700 in an extended, but stowed position. An actuating mechanism within each leg 708 moves movable upper frame 704 upward in an amount determined by the user. FIGS. 8A-8D, in particular, show work station 700 fully extended. However, it should be apparent that work station 700 can be deployed to any height between that depicted in FIGS. 7A-7D and 8A-8D.

Figure 8A:
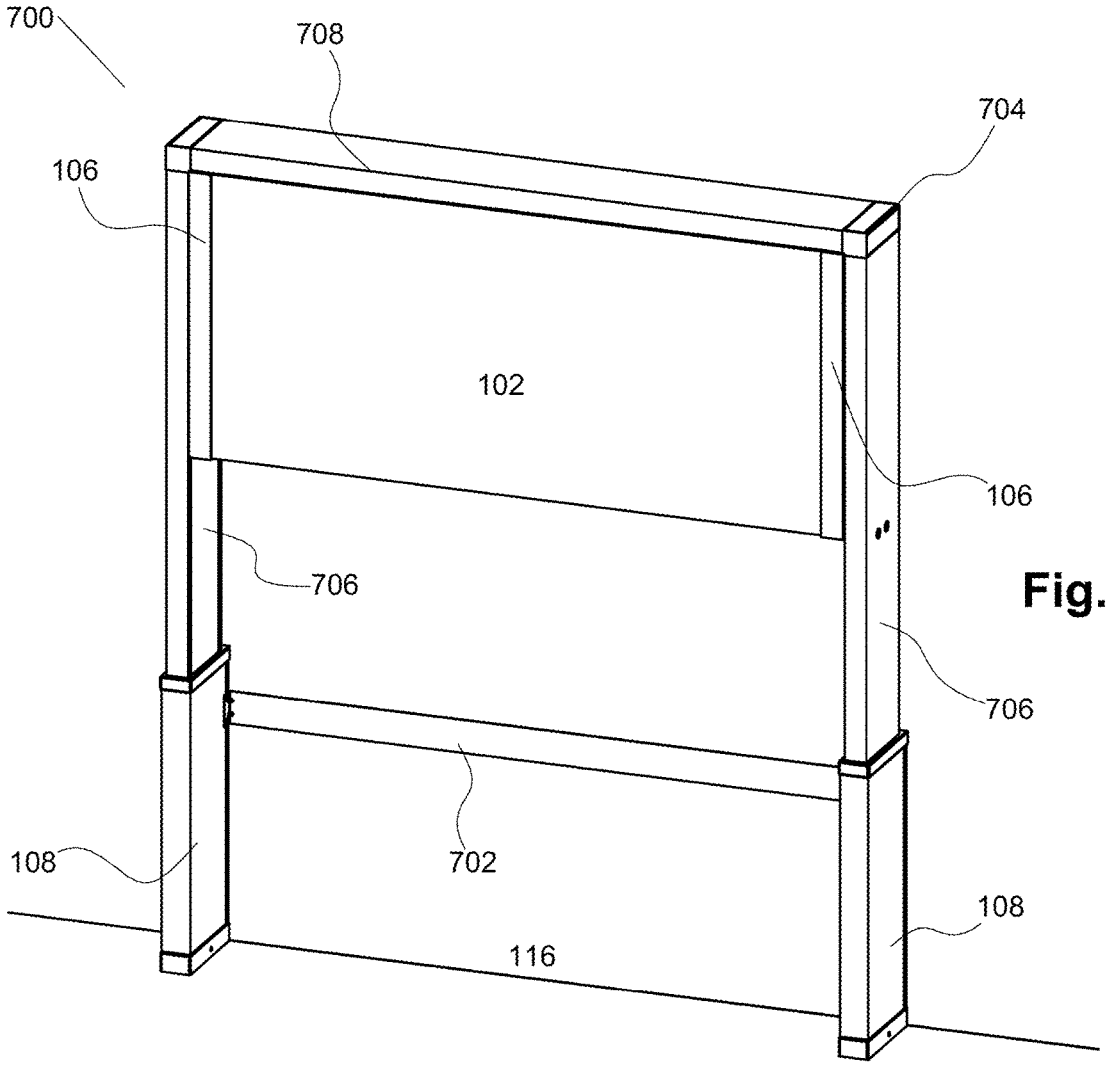
FIGS. 8A-8D depict views of the work station of FIG. 7A in an extended and stowed position.
Figure 8B:
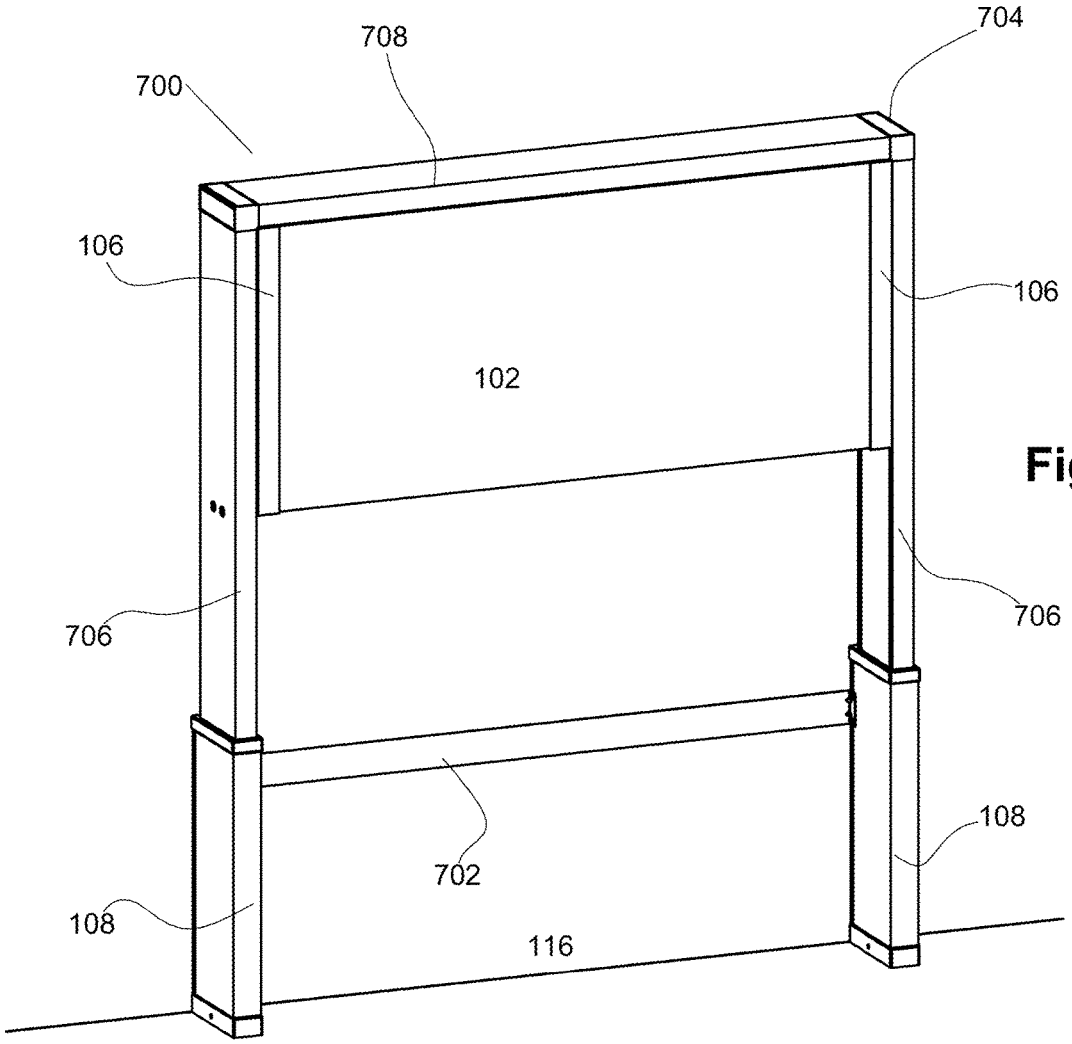
Figure 8D:
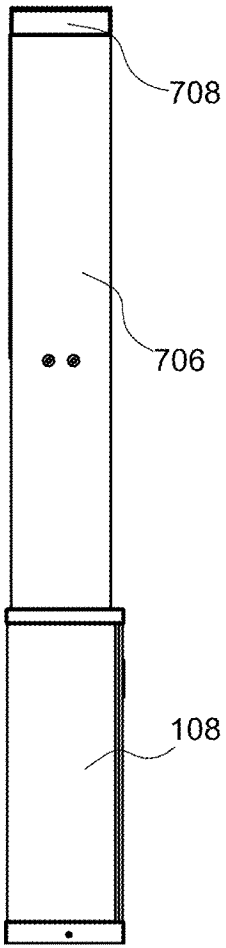
Figure 8C:
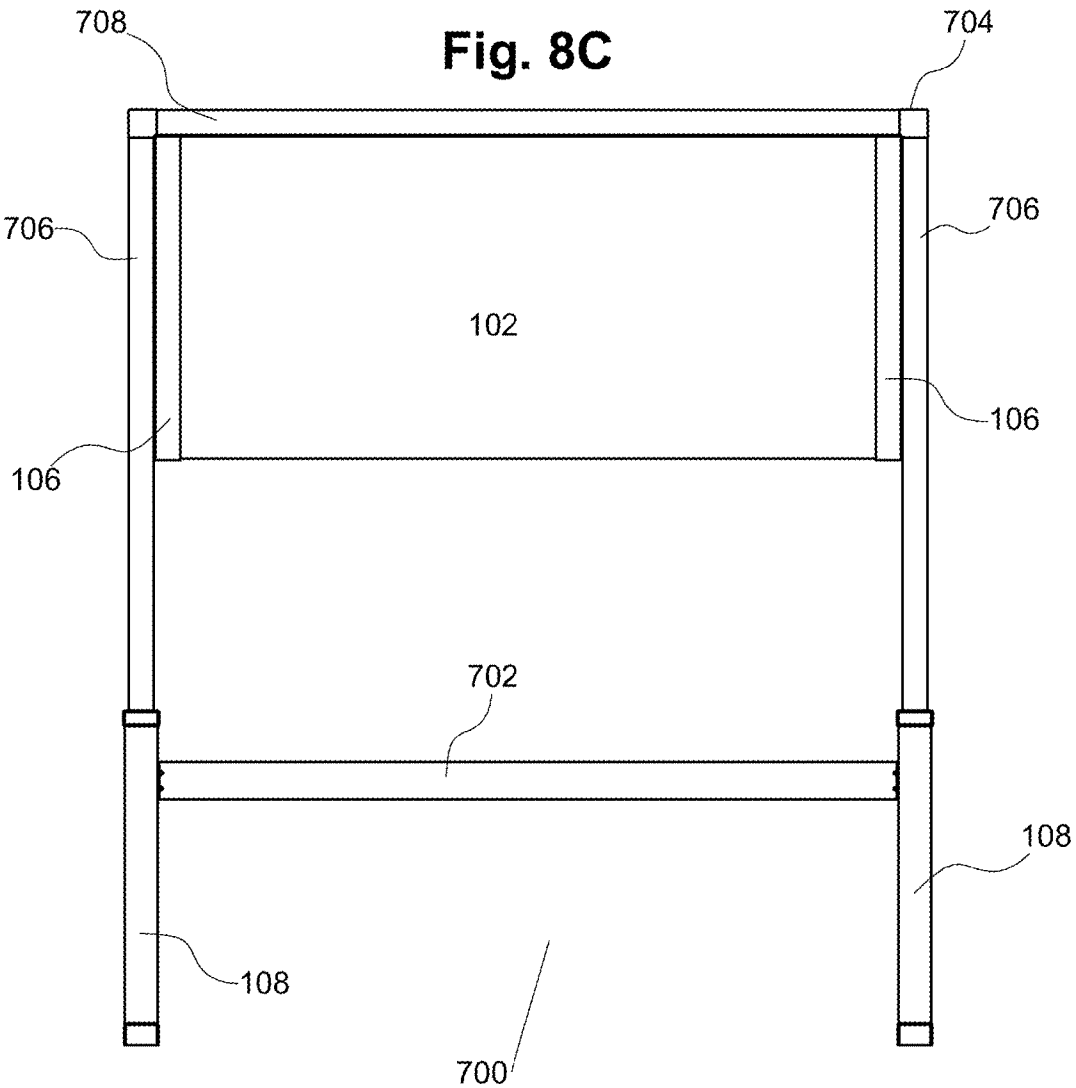

In these views, it is more apparent that supports 706 have a height greater than that of legs 108. Otherwise, movable upper frame 704 would not be extendible between the retracted position and the extended position. FIG. 8C depicts that work station 700 may have an extended height of approximately 75-76". However, it should be apparent that the extension height of work station 700 can easily be varied by changing the relative heights of supports 706 and/or legs 108.

FIGS. 9A-9E depict views of work station 700 in a retracted, but deployed, position. Work surface 102 has been pivoted downward 90° about hinges 714 which couple arms 106 to supports 706. After work surface 102 has been pivoted, it can be used as a table top or desk by a user because protected member 114 have now been revealed. In this embodiment, protected member 114 comprises one or more monitors coupled to bar 112 by a dual monitor stand.

Figure 9A:
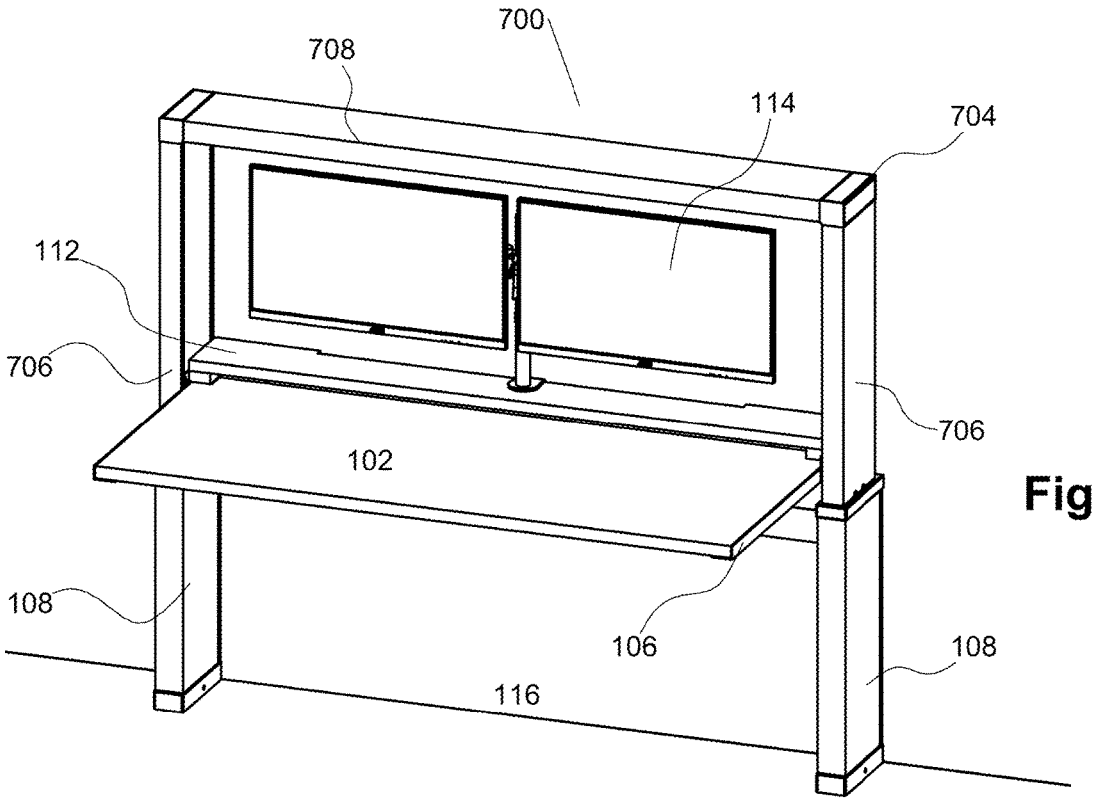
FIGS. 9A-9E depict views of the work station of FIG. 7A in a retracted and deployed position.
Figure 9B:
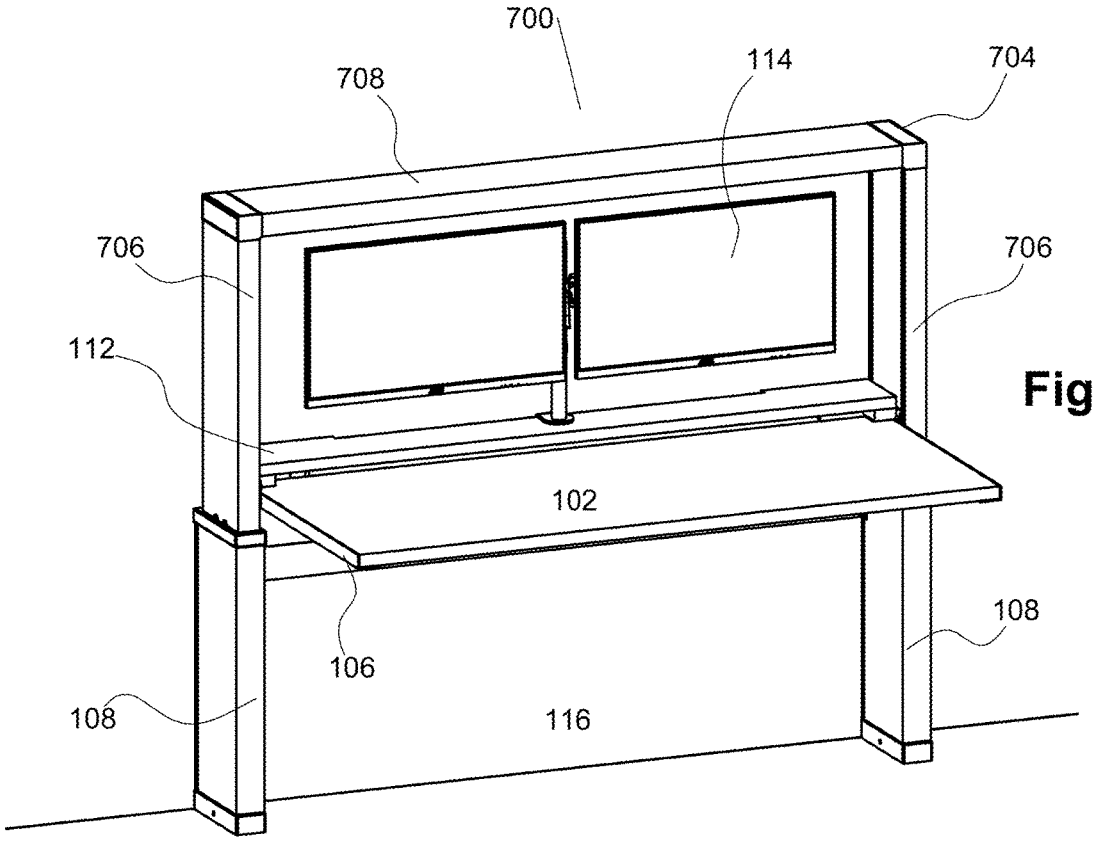
Figure 9D:
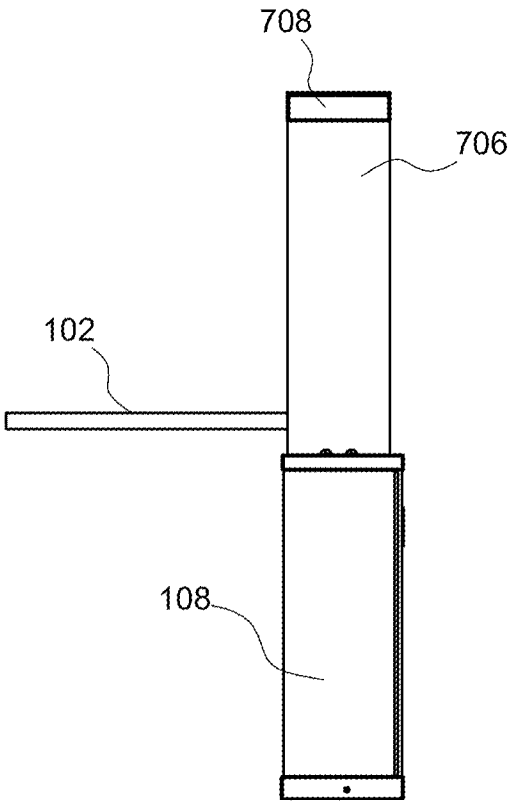
Figure 9C:
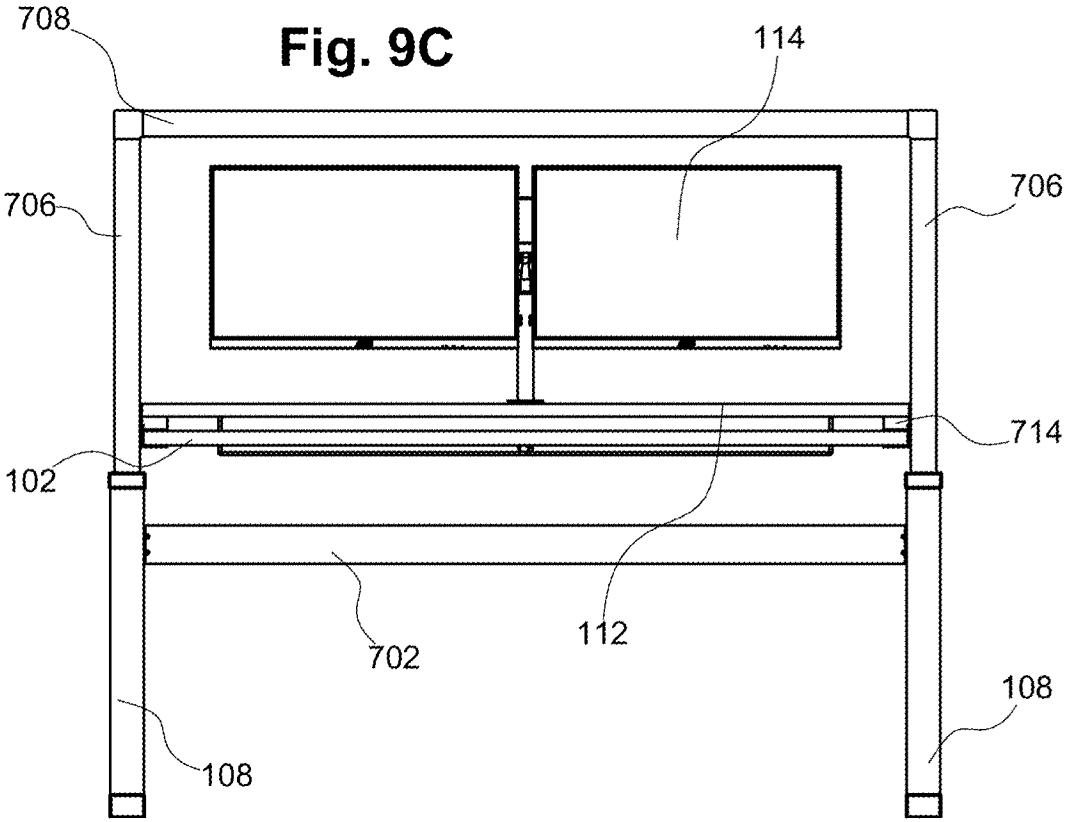

As depicted in FIG. 9C, a height of work surface 102 is preferably 30" when deployed so that work surface 102 can be utilized with standard office chairs. Bar 112 is preferably 2-2.5" above work surface 102 when work surface has been deployed. In addition to containing protected member 114, bar 112 can be used to store other items such as stationary, an upright laptop, keyboard, mouse, etc., that the user may require when working. Bar 112 has a width slightly less than that of supports 706 so that work surface 102 can be closed flush with the front of movable upper frame 704 when work surface 702 is in the closed position.

Figure 9E:
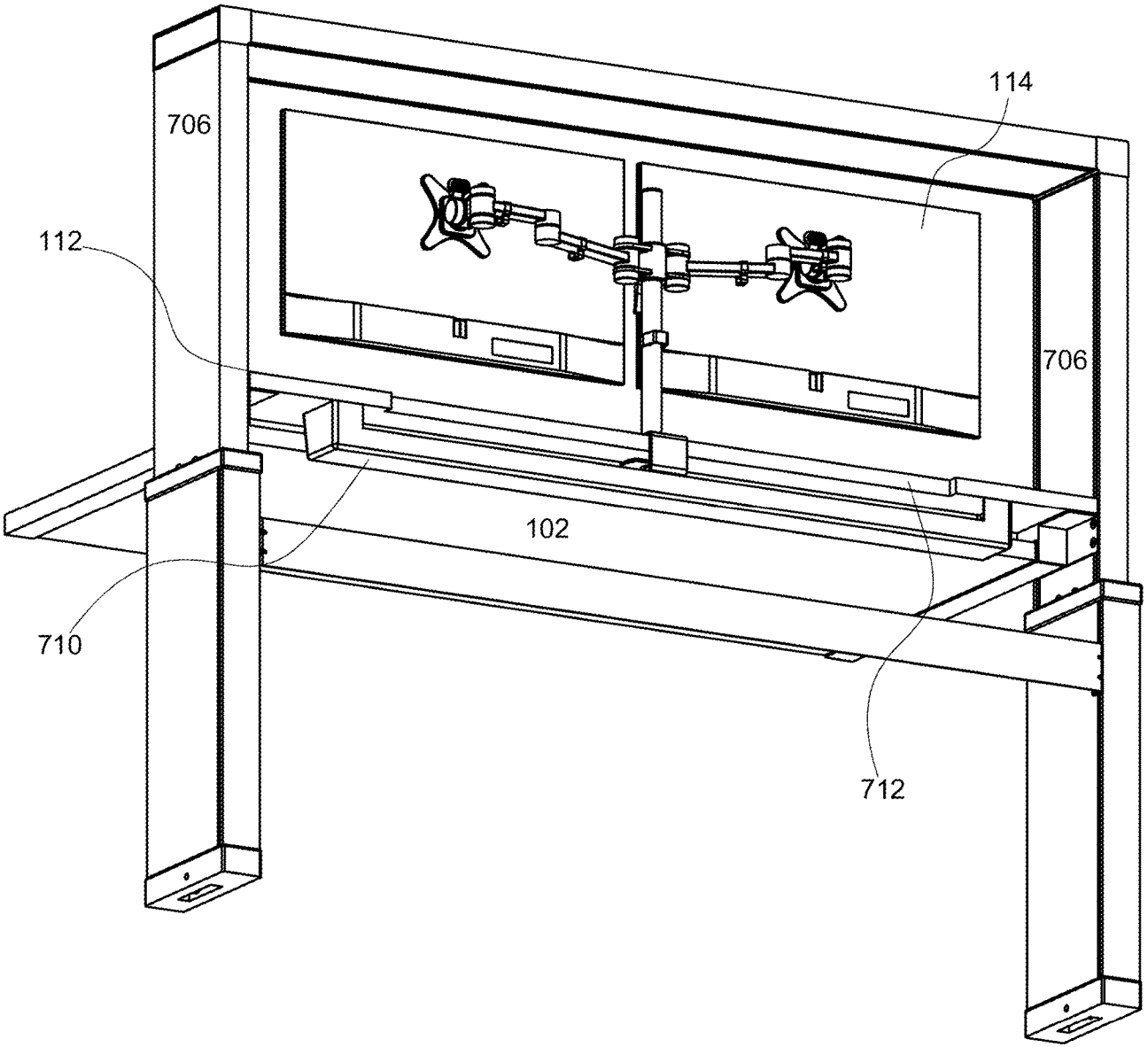

FIG. 9E depicts a rear of work station 700 showing how an arm 106 is coupled to an interior surface of support 706. Further, this view depicts that a bumper 710 may be mounted to a lower surface of bar 112. Bumper 710 is preferably slightly less than a width of work surface 102 and a front surface of bumper 710 engages a rear surface of work surface 702, preventing any further rotation. The front surface of bumper 710 is preferably a hard rubber or foam to cushion work surface 102 as it is pivoted into the deployed position.

A rear surface of bar 112 may further comprise cutout 712 to allow for extra clearance for movement of protected member 114 or thicker plugs and cords for items stowed on bar 112.

Figure 10A:
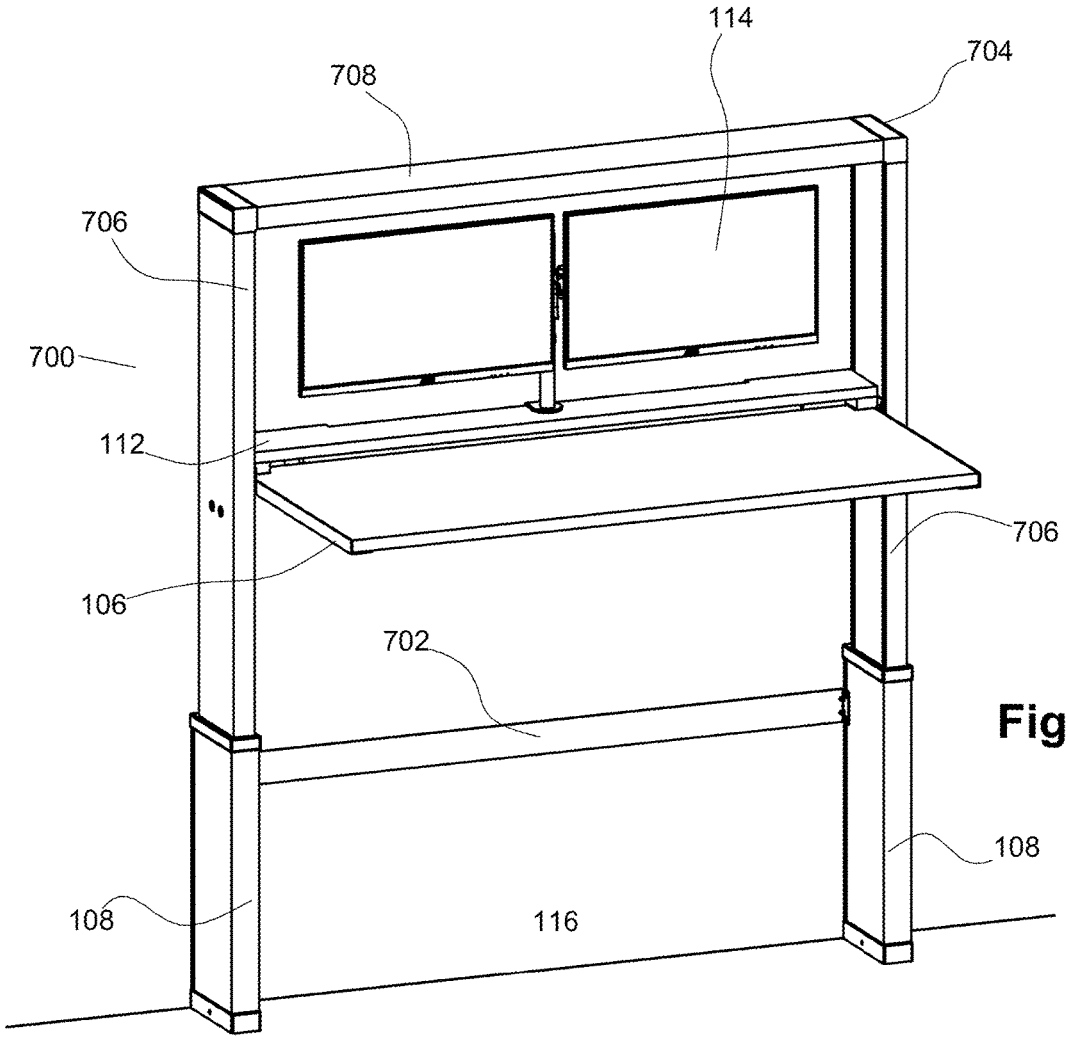
FIGS. 10A-10D depict views of the work station of FIG. 7A in an extended and deployed position.
Figure 10B:
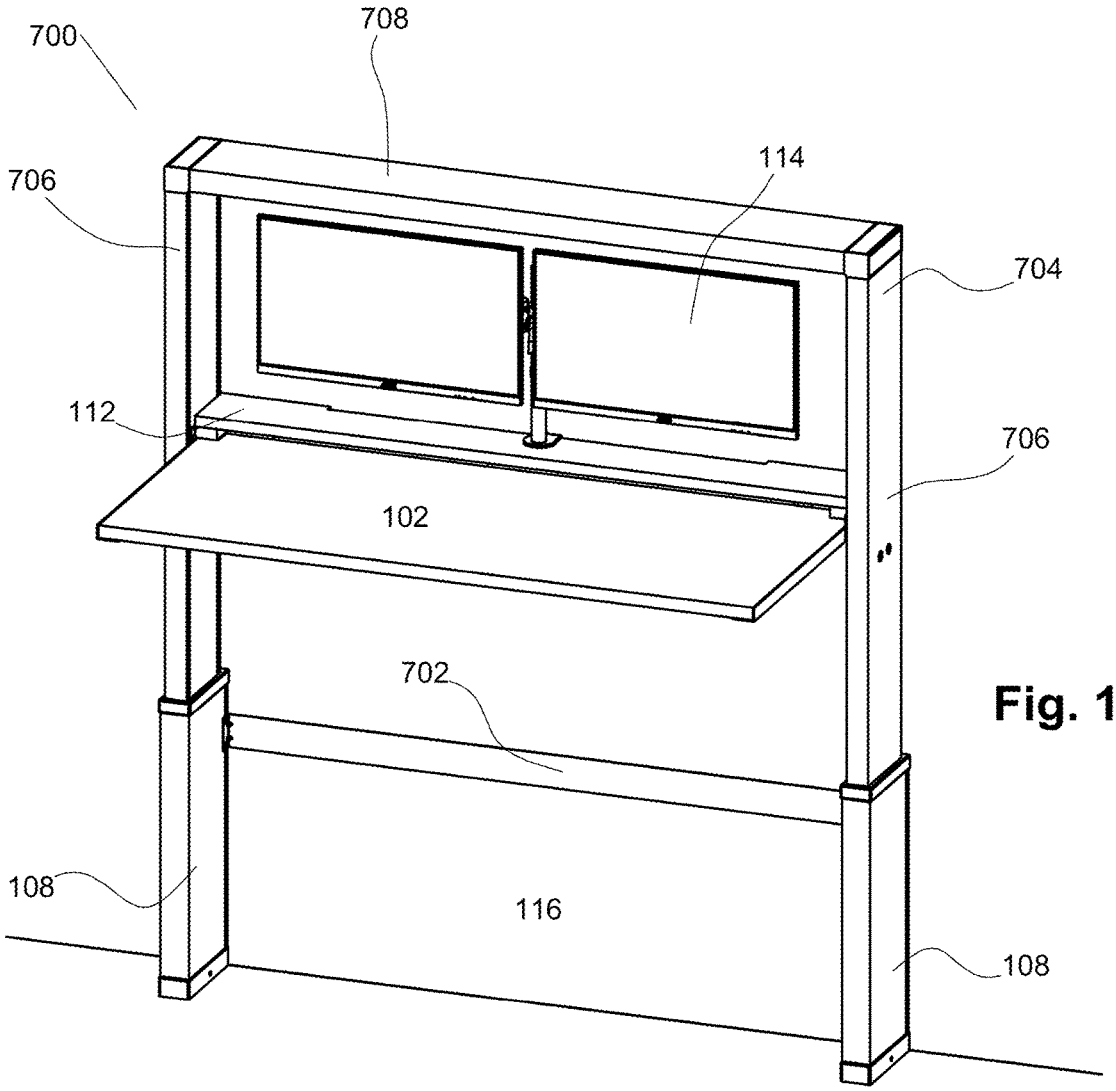
Figure 10D:
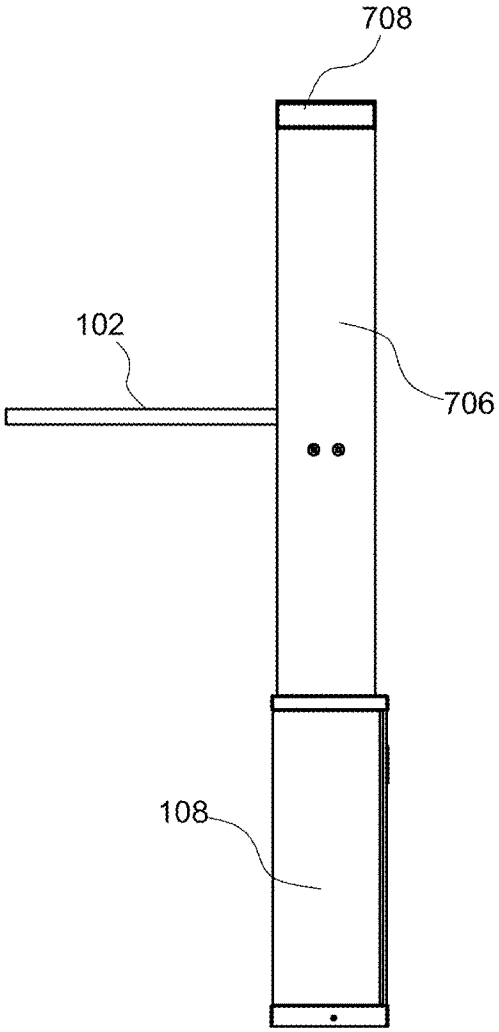
Figure 10C:
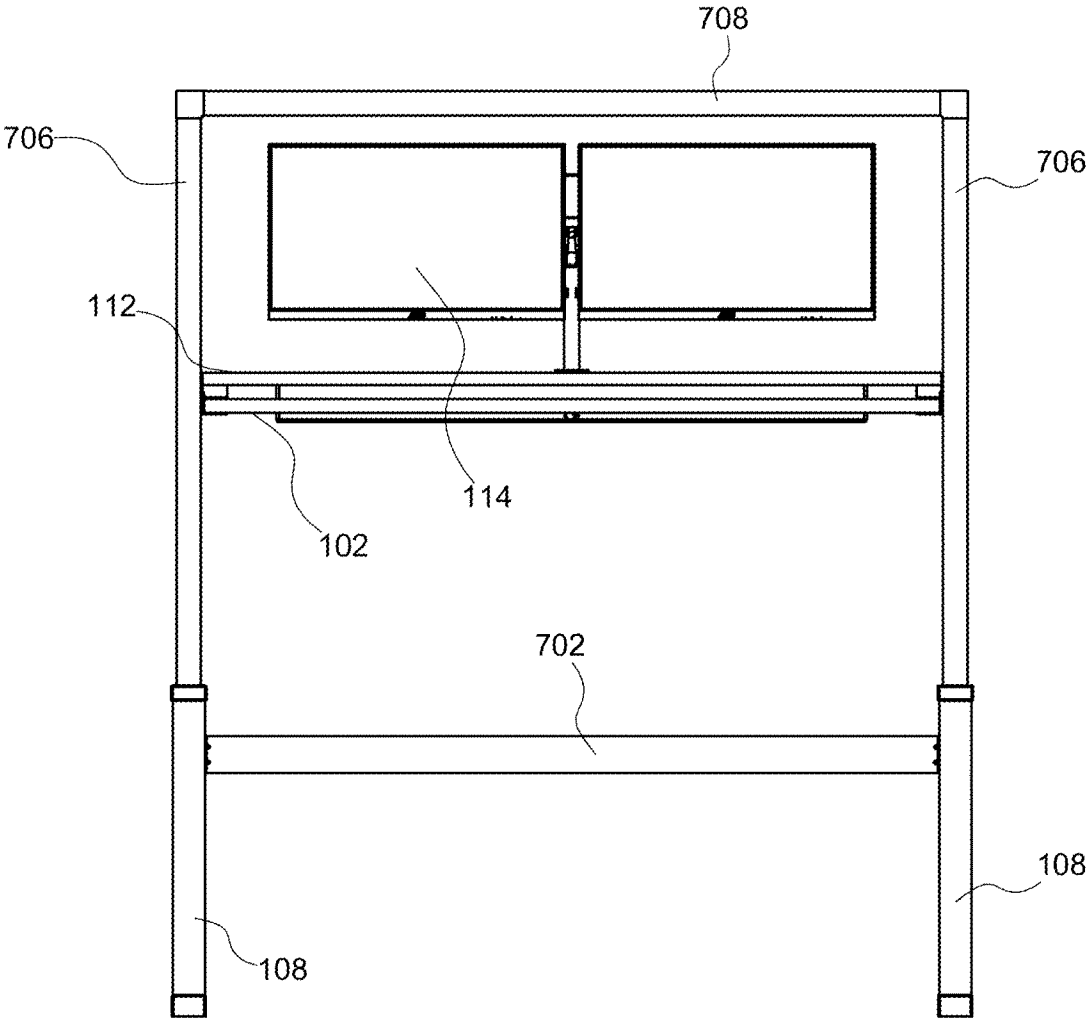

FIGS. 10A-10D depict work station 700 in an extended and deployed position, allowing work station 700 to be used as a standing desk. As depicted in FIG. 10C, work surface 102 preferably has a height of 50" when movable upper frame 704 is fully extended. Work surface 102 may have a width of approximately 60-60.5" and a depth of approximately 30".

Figure 11A:
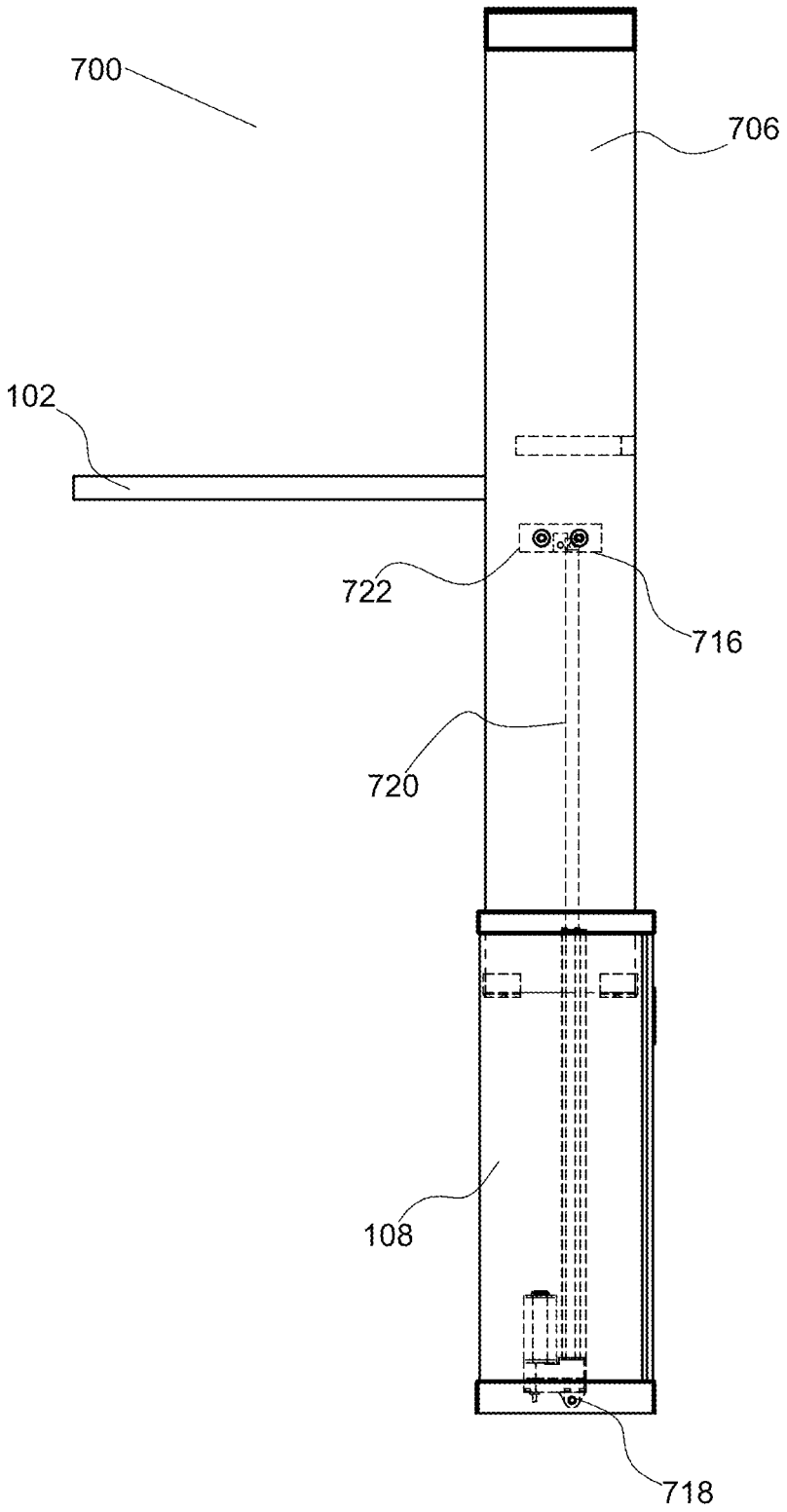
FIGS. 11A-11B depict schematics of the actuation mechanism used to move the work station between the retracted and extended positions.
Figure 11B:
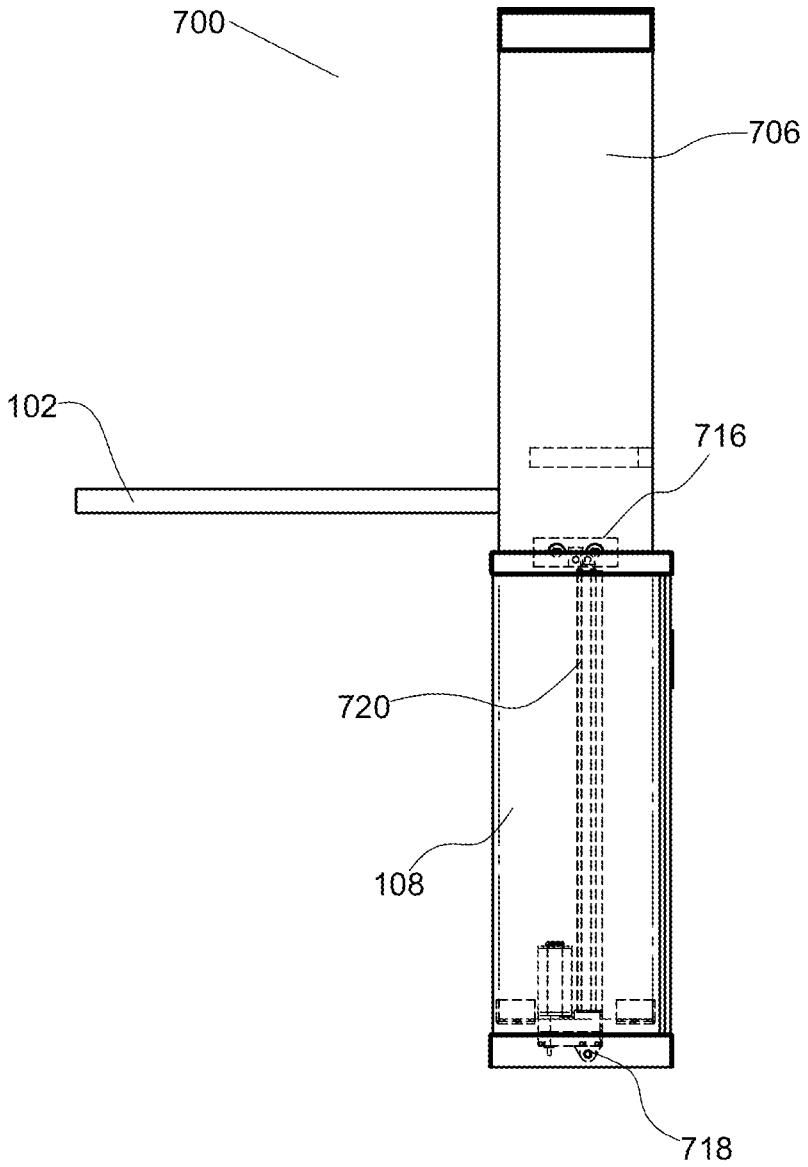

FIGS. 11A-11B depict a side view of work station 700 showing the actuating mechanism 716 utilized to move movable upper frame 704 between the retracted (FIG. 11A) and extended positions (FIG. 11B). Each leg 108/support 706 has an actuating member 716 mounted on the interior. A first part of the actuating member 716 is fixed to leg 108 and a second part is fixed to support 706. The extension and retraction of actuating mechanism 706 causes the lowering and raising of work station 700. Preferably, each leg 108/support 706 comprises an actuating mechanism 716.

Actuating motor 718 is mounted near a bottom of a leg 108. An actuating arm 720 extends within the interior of leg 108 into the interior of support 706 and is affixed to the support 706 by a block. One or more bushings 722 couple the bottom of support 706 to actuating arm 720. Rotation of actuating arm 720 by actuating motor 718 causes support 706 to be raised or lowered as is known in the art of linear actuators. It should also be apparent to one of ordinary skill in the art that other types of raising or lower mechanisms, such as hydraulic or ratcheting systems, could also be used as actuating mechanism 716.

The interior of leg 108 and support 706 may comprise a track system which enable the two members to telescope with respect to each other in a smooth manner. Any type of track system may be utilized including linear sliding tracks, track and wheel combinations, etc.

Figure 12:
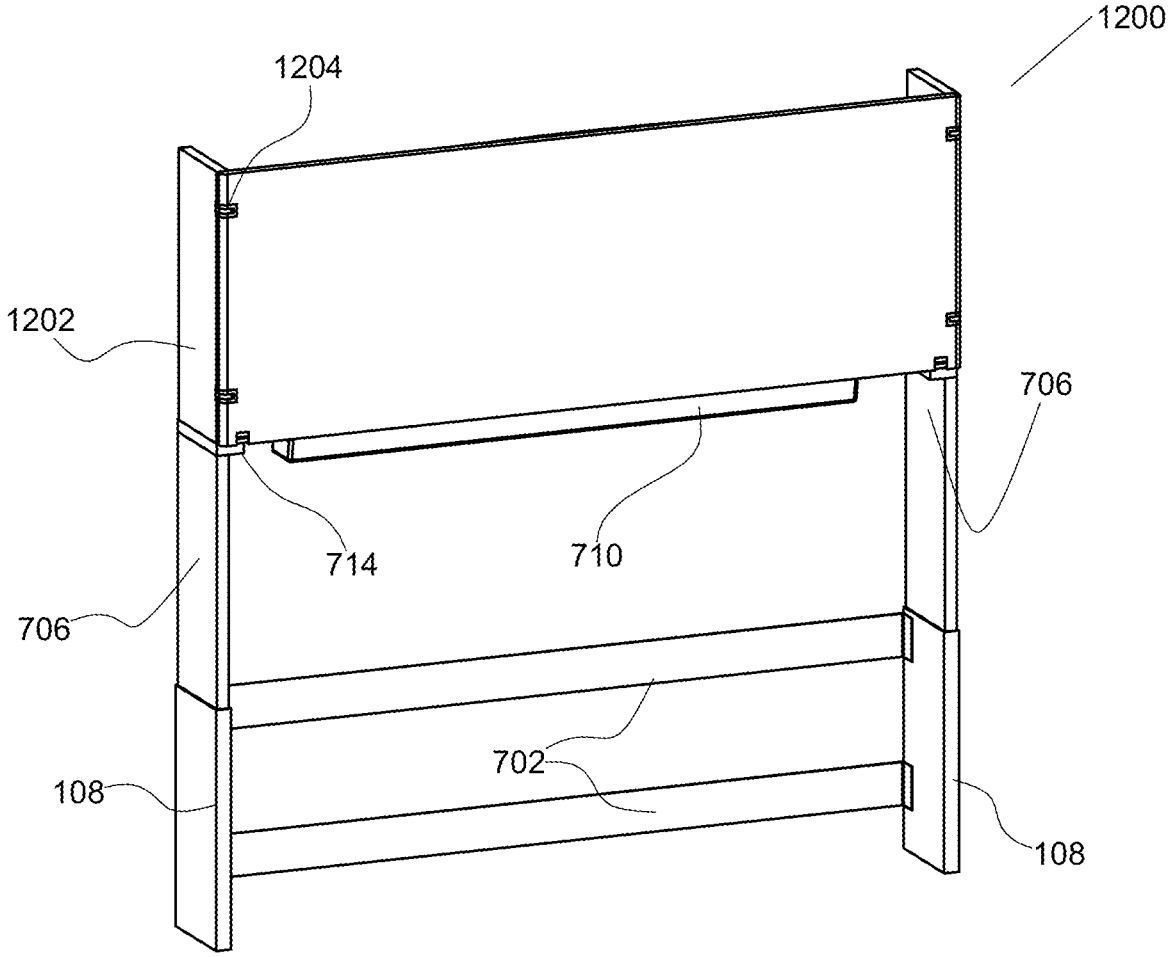
FIG. 12 depicts an embodiment of a work station in a stowed position.
Figure 13:
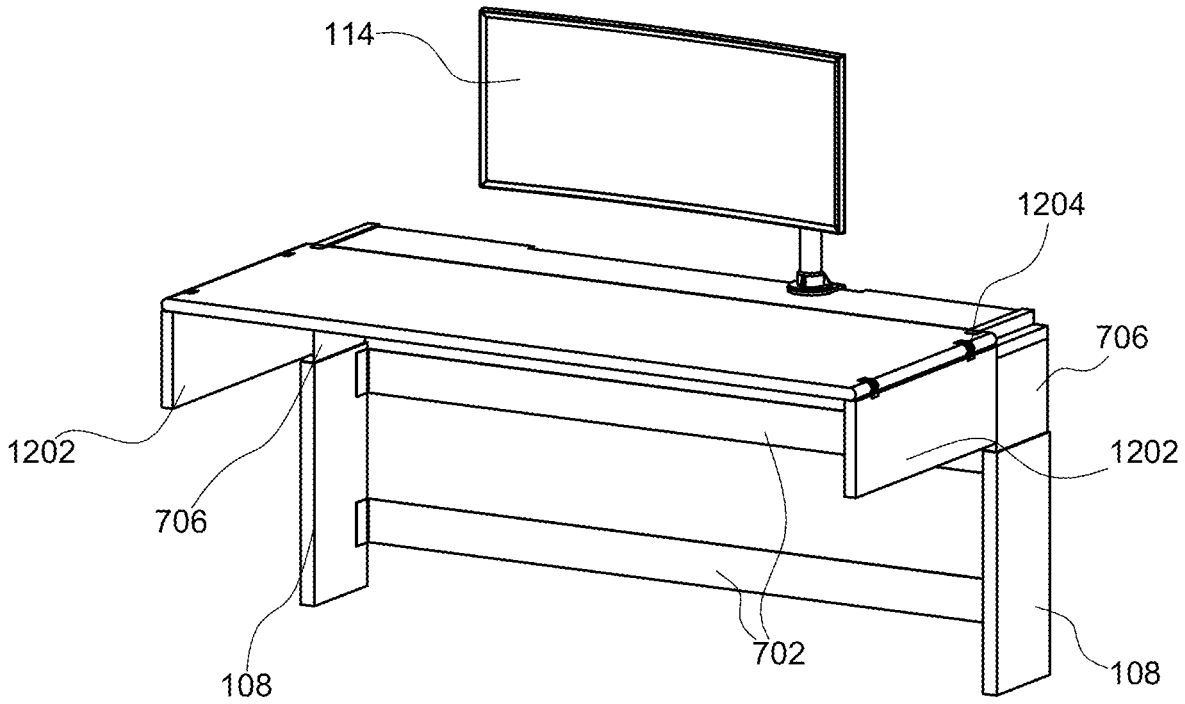
FIG. 13 depicts the work station of FIG. 12 in a deployed position.

FIGS. 12 and 13 depict another embodiment of a work station 1200 similar to that depicted in FIGS. 7A-11. In this embodiment, the upper portions of supports 706 have been shortened and top rail 708 has been removed. In addition, a pair of hinged wings 1202 are coupled to opposing ends of work surface 102 by hinges 1204. When work station 1200 is in the stowed position and work surface 102 is raised, wings 1202 can be folded towards the wall so that a bottom surface of each wing 1202 rests on a top surface of supports 706 as depicted in FIG. 12. This configuration allows wings 1202 to help support work surface 102 remaining in the stowed position while still protecting protected member 114.

As shown in FIG. 13, work surface 102 is coupled to a top rail 1302 by one or more hinges 1304, preferably joining an underside of work surface 102 to an underside of top rail 1302. The protected member 114 is coupled to the top surface of top rail 1302. Hinges 1304 allow the work surface to rotate between an open position (FIG. 13) and a closed position (FIG. 12).

In order for wings 1202 to be able to rest on supports 106, a width of work surface 102 is longer than that of top rail 1302. 700. As depicted in FIGS. 12 and 13, the length of work surface 102 extends to be flush with the outer edge of supports 106. FIG. 13 depicts work station 1200 in the deployed and retracted positions. As work surface 102 is pivoted down about hinges 1304, a rear of work surface 102 contacts bumper 710 which may also prevent any further rotation (see FIG. 9E). Wings 1202 remain folded downward and contact a front surface of supports 706 to help support work surface 102. Alternatively, wings 1202 can be extended and locked to be parallel with the top surface of work surface 102, allowing for extension of the desk top surface available to the user. Any known apparatus can be utilized to lock wings 1202 in the parallel configuration including pins, locking hinges, etc.

Work station 1200 further comprises two cross beams 702 instead of the single cross beam depicted in work station 700. It should be obvious to one of ordinary skill in the art that any of the embodiments described herein can include any number of cross beams 702.

The work stations shown and described in FIGS. 1A-17 are appropriate for all types of uses including typing while viewing a monitor or other form of virtual display, and writing while viewing a monitor. When stowed in the first position, the shielding member described above protects the protected member from damage including but not limited to damage from: projectiles, sharp objects, furniture, errant human appendages, and liquids. Additionally, all connections between: the base and the work surface; the shielding member and the at least one arm; the at least one leg and the at least one foot; the supporting member and the base; and all other joints and connections in the work station may be made by any appropriate connector such as: a mechanical device (including a screw, and/or nut and bolt), a mechanical joint, an adhesive, an interference fit, or any other appropriate known connecting mechanism.

Figure 14:
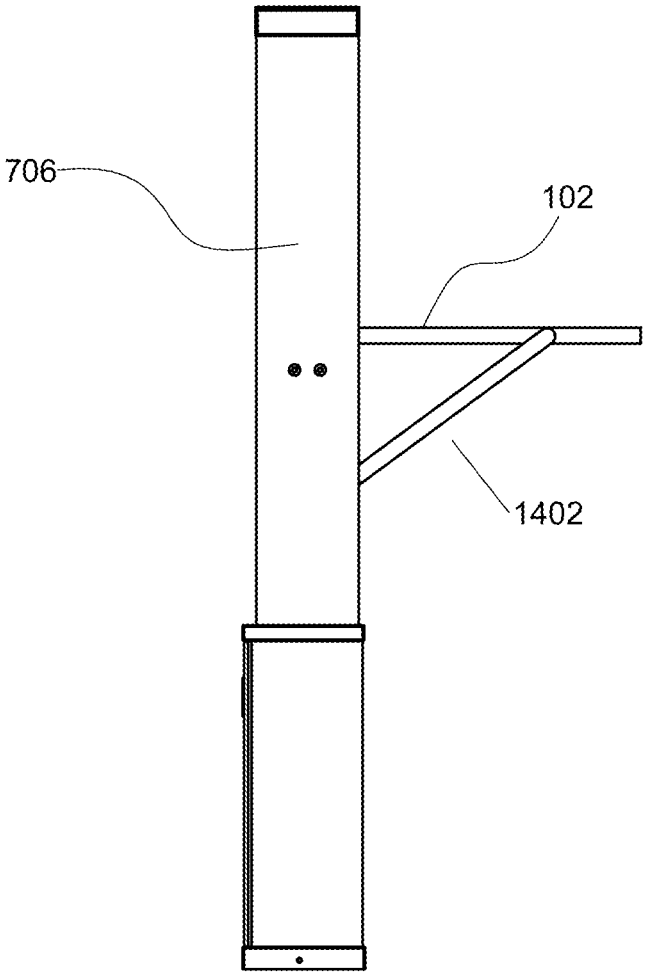
FIG. 14 depicts a work station with a cantilever arm extending from the leg to support the work surface.

FIGS. 14, 15A, and 15B and 15 depict cantilever support 1402 and frame support 1502 which can be used to help support work surface 102. As shown in FIG. 14, cantilever support 1402 is preferably pivotally connected to work station 700 and contacts a side or underside of work surface 102 to help support it.

Figure 15A:
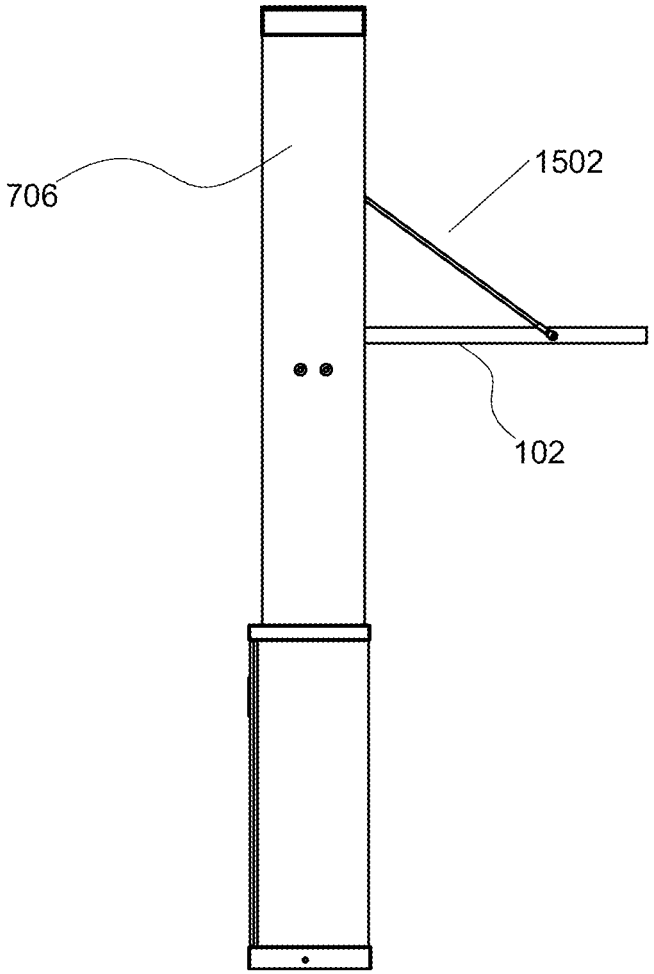
FIGS. 15A-15B depict a support structure extending from the frame to support the work surface.
Figure 15B:
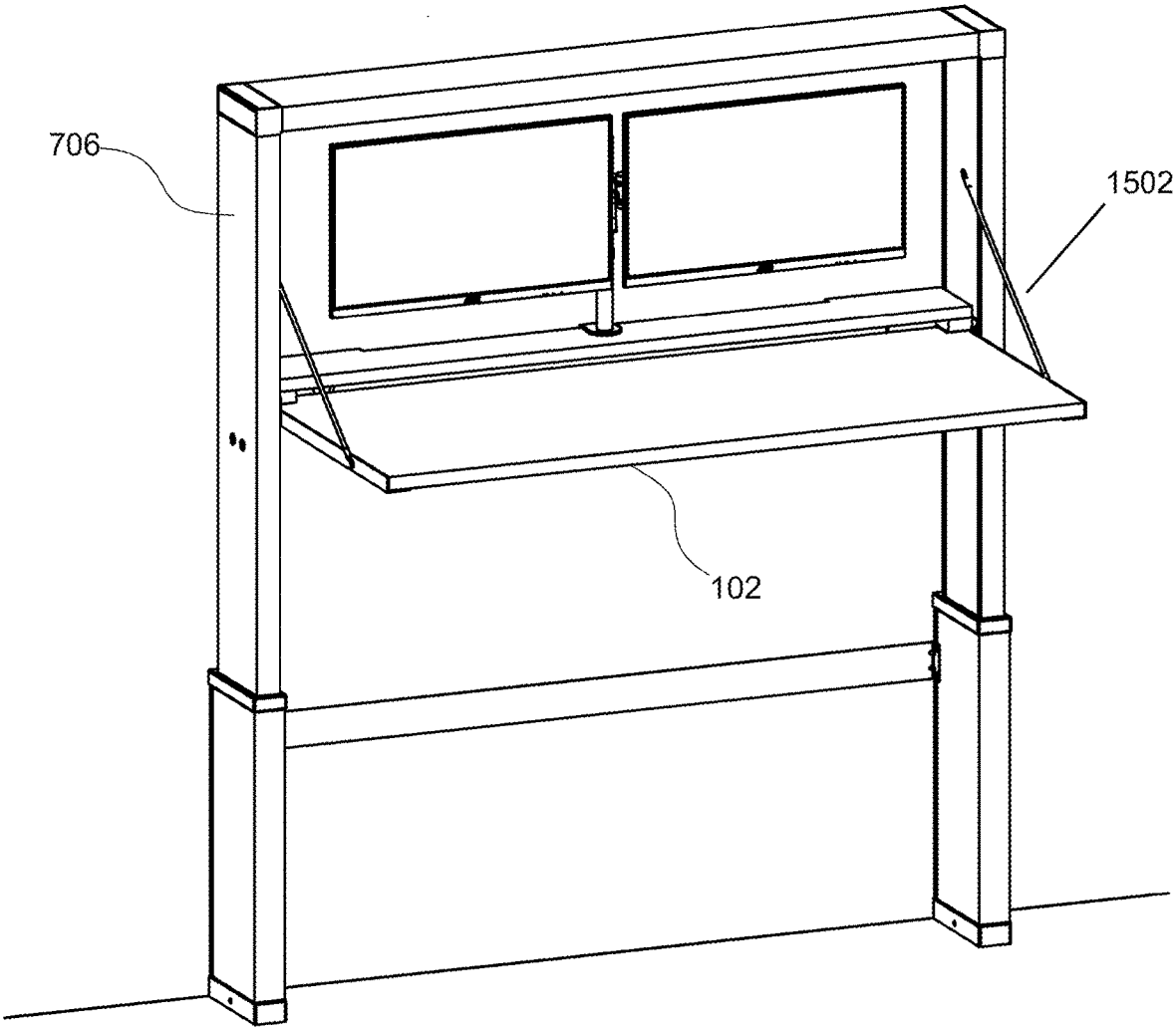

FIGS. 15A and 15B depict chain 1502 which is used to help support work surface 102. In this embodiment, a first end of chain 1502 is coupled to an interior or exterior of each support 706 and a second end of chain 1502 is coupled to a side or top of work surface 102. The length of chain 1502 limits how far work surface 102 can work. Chain 1502 can be made from any flexible, rope like construction such as a chain, a rope, a metal braid, string, metal wire, etc.

Figure 16A:
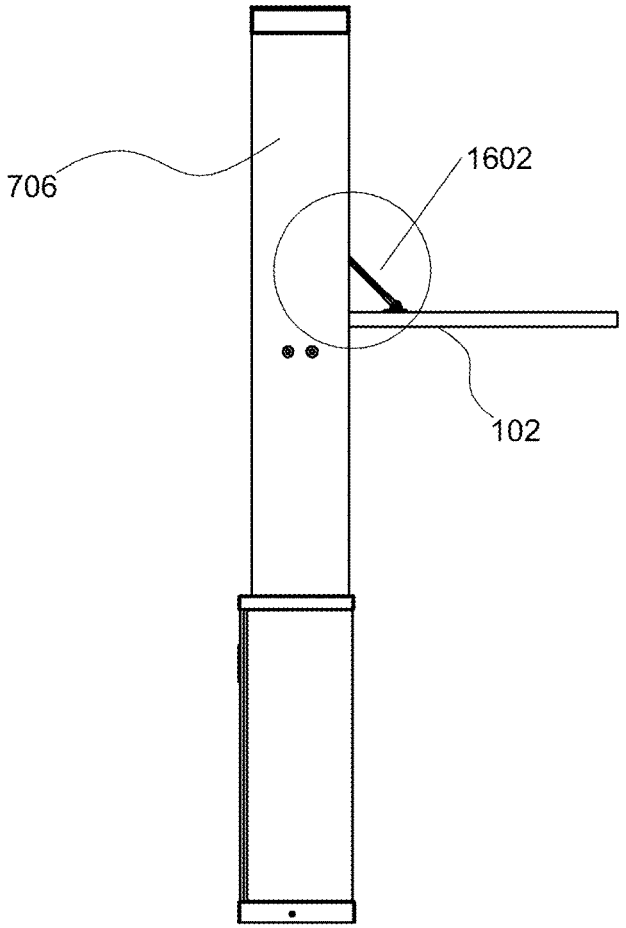
FIG. 16A-16D depict a soft close hinge used to support the work surface.
Figure 16B:
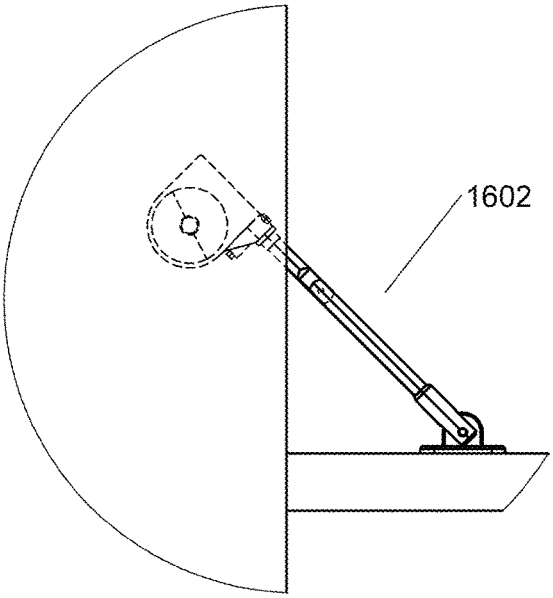
Figure 16C:
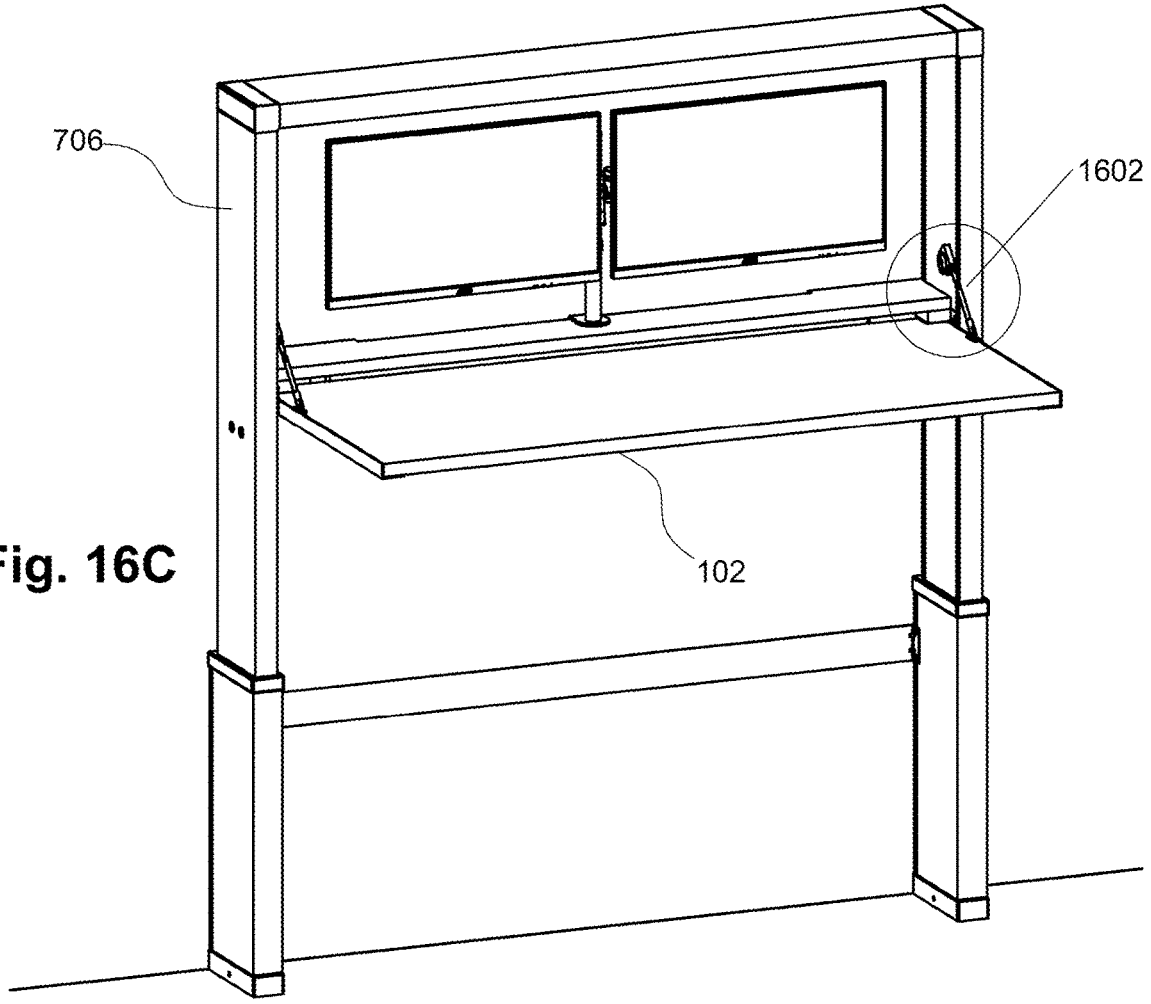
Figure 16D:
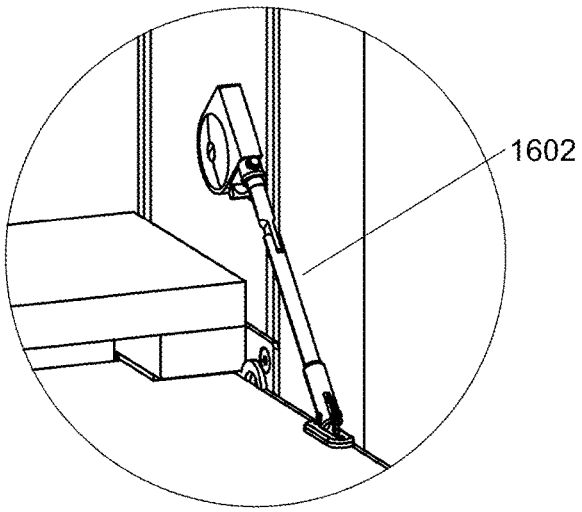

FIGS. 16A-16D depict an embodiment in which a soft close hinge 1602 is used to couple supports 706 to work surface 102. As best shown in FIG. 16D, a first end of soft close hinge 1602 is rotatably coupled to an interior of support 706 and a second end of soft close hinge 1602 is coupled to a top surface of work surface 102. Soft close hinge 1602 uses a pneumatic plunger to limit the speed at which work surface 102 can be lowered without limiting the speed at which work surface 102 can be raised.

Figure 17:
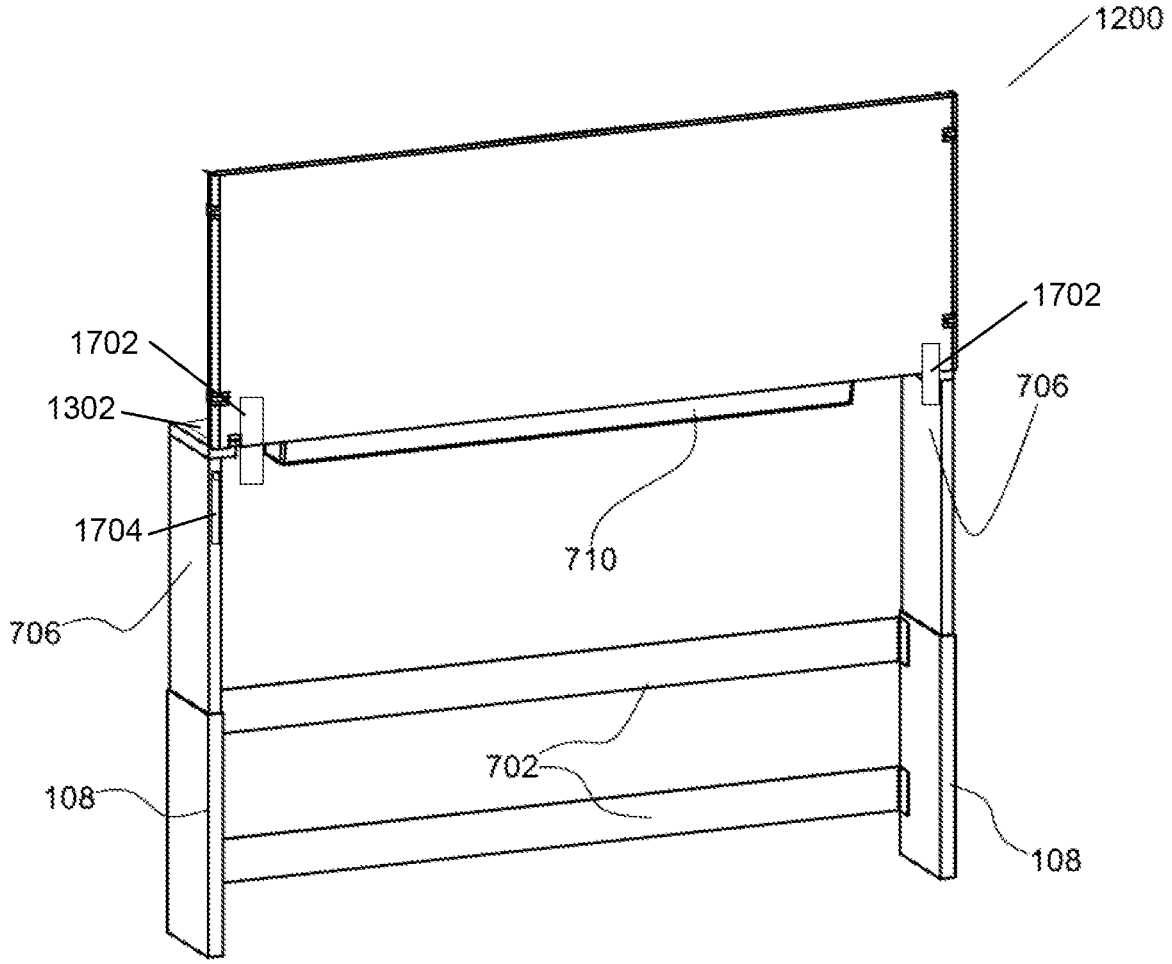
FIG. 17 depicts an alternate embodiment of the work station of FIG. 7 with the wings removed.

FIG. 17 depicts an alternate embodiment of workstation 700 of FIG. 7. The wings 1202 are not present in the depicted embodiment. Two rectangular stoppers 1702 are coupled to the edge of work surface 102 in the vicinity of supports 706. Stoppers 1702 reinforce hinges 704 by contacting the underside of top rail 1302 when work surface 102 is lowered for use. A swivel lock 1704 located on one or more supports 706 and can be rotated upward to help maintain work surface 102 in the raised position.

Figure 18:
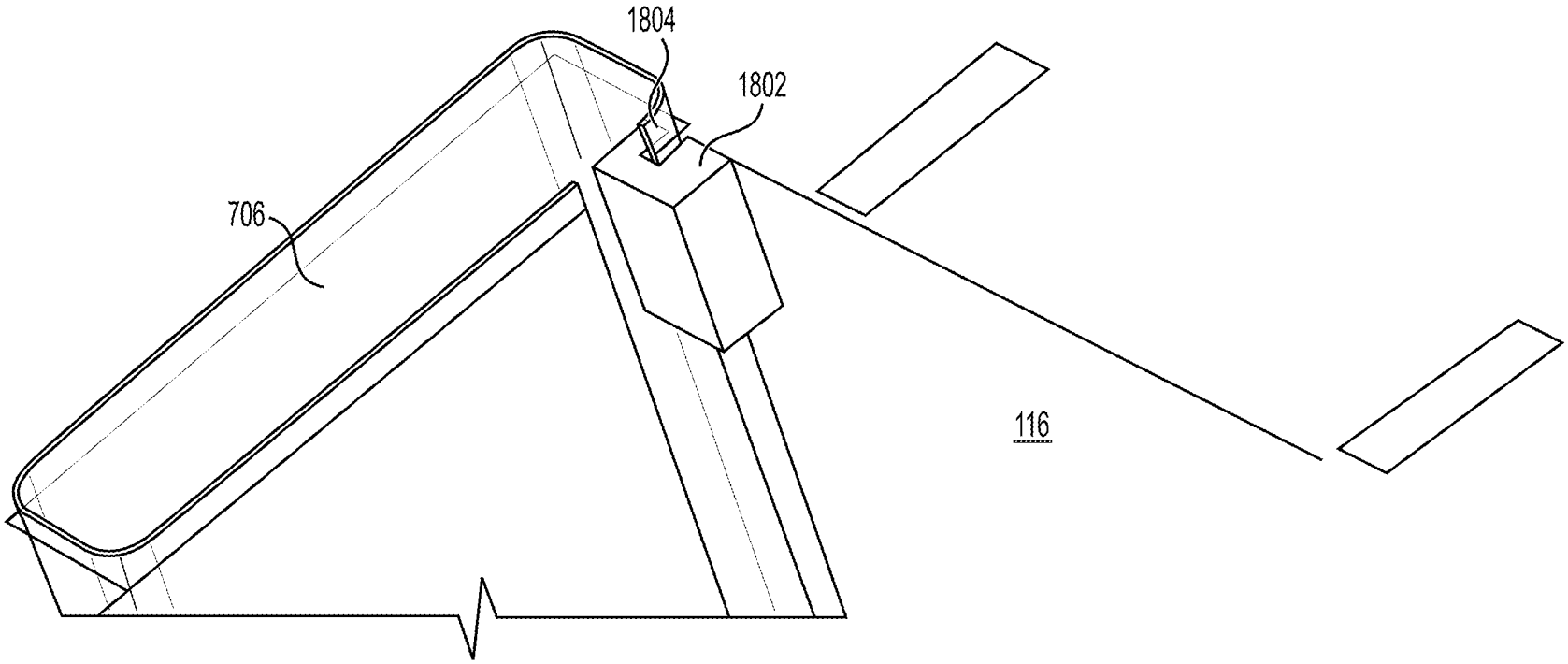
FIG. 18 depicts a stability structure for the upper support members.

FIG. 18 depicts a stabilization block 1802 coupled to a support 706. In a first embodiment, the stabilization block has an L-shape with a first part of the support 706 being coupled to the wall. The stabilization block 1802 extends outward and a portion extends toward and over a lip on support 706 without contacting support 706 so it does not hinder the upward/downward motion of support 706. One or more stabilization blocks 1802 may be used with each support 706. This embodiment of the stabilization block helps to prevent accidental tipping of the work station 700 if a pulling force is applied. The L-shape of the stabilization block 1802 prevents the supports 706 from moving more than a predetermined distance away from wall 116.

In another embodiment shown in FIG. 18, each stabilization block 1802 has a C-shape and each support 1706 has a ridge 1804. One portion of the C is used to couple the stabilization block 1802 to the wall and the other section of the C extends over the ridge 1804. The ridge 1804 may contact one or more rollers that reside in the groove formed by the C-shape of stabilization block 1802. The stabilization block of 1802 helps to stabilize supports 1802 as they are raised and lowered by ensuring that they move linearly up and down. In some embodiments, the stabilization block 1802 may have a T-shape. The stem of stabilization block 1802 is mounted to the wall behind each support 706. The cross of T-shaped stabilization block 1802 would reside within a groove in each support 706, with the stem being fixed to the wall. The groove has a width less than that of the cross of stabilization block 1802. Stabilization block 1802 would thus be internally coupled to support 706 which still allowing vertical displacement of supports 706.

Other mechanisms may also be used to help support work surface 102 in the deployed position. For example, two rotatable wooden beams may be coupled to legs 108 and lock into an underside of work surface 106 to provide support. Triangular members may have a first side coupled to a leg 108 via a hinge so that a top flat surface of the triangular member can support a bottom of work surface 102 when rotated outward, and can be rotated inward to allow work surface 102 to be stowed.

Alternatively, a support could be fixed to the bottom of work surface 102 and have a hinged member that can be rotated and placed into a groove in leg 108 to support work surface 102 when in use. The hinged member can then be rotated to be flush with the desk to allow work surface 102 to be lowered.

It will be understood that the embodiments described above are illustrative of some of the applications of the principles of the present subject matter. Numerous modifications may be made by those skilled in the art without departing from the spirit and scope of the claimed subject matter, including those combinations of features that are individually disclosed or claimed herein. For these reasons, the scope hereof is not limited to the above description but is as set forth in the following claims, and it is understood that claims may be directed to the features hereof, including as combinations of features that are individually disclosed or claimed herein.

The invention claimed is:

1. A work station comprising:

a first leg;

a second leg;

an upper frame, comprising:

a first support coupled to the first leg;

a second support coupled to the second leg; and a cross member coupling the first support to the second support, wherein the upper frame is height adjustable with respect to the first leg and the second leg;

a work surface rotatably coupled to the upper frame, wherein the work surface is movable between a first position and a second position by rotating the work surface downwards, wherein the work surface is vertical in the first position, and wherein the upper frame and the work surface form a protected space when the work surface is in the first position; and an actuating mechanism for adjusting a height of the upper frame with respect to the first leg and second leg.

2. The work station of claim 1, wherein the cross member is a shelf positioned at a same level or above the work surface when the work surface is in the second position.

3. The work station of claim 1, wherein the cross member couples a top surface of the first support to a top surface of the second support.

4. The work station of claim 3, wherein the work surface is configured to nest between an area bounded by the upper frame and the cross member when the work surface is in the first position to form the protected space.

5. The work station of claim 1, wherein the actuating member is a pair of linear actuators.

6. The work station of claim 1, further comprising:

a first base that is coupled to the first leg and a second base that is coupled to the second leg wherein the first base and the second base provide further stability for the work station.

7. The work station of claim 6, wherein the first base and the second base are configured to rotate to decrease a profile of the work station.

8. The work station of claim 1, wherein the first leg and the second leg are detachably coupled to a wall by a wall mount.

9. The work station of claim 8, wherein the first leg and the second leg do not contact a ground surface.

10. The work station of claim 8, further comprising:

at least one stabilization block coupled to the first support, wherein the at least one stabilization block is configured to prevent the first support from moving more than a predetermined distance away from the wall.

11. The work station of claim 10, further comprising:

a second stabilization block coupled to the second support.

12. The work station of claim 10, wherein the at least one stabilization block is coupled to the wall mount.

13. The work station of claim 10, wherein a first portion of the at least one stabilization block extends beyond a portion of the first support.

14. The work station of claim 13, wherein a second portion of the at least one stabilization block is coupled to the wall mount.

15. The work station of claim 13, wherein the at least one stabilization block is C-shaped.

16. The work station of claim 1, further comprising:

a wall mount coupled to the wall; and a cross bar coupling the first leg to the second leg, wherein the cross bar is detachably coupled to the wall mount.

17. The work station of claim 1, wherein the upper frame generates stability through its coupling to an exterior of the first leg and to an exterior of the second leg.

18. The work station of claim 1, wherein the upper frame is coupled to an exterior of the first leg and to an exterior of the second leg.

19. The work station of claim 1, wherein a top of the upper frame remains above a top of the first leg and a top of the second leg through an entire range of height adjustability.

* * * * *